US007848922B1

(12) United States Patent
Jabri et al.

(10) Patent No.: US 7,848,922 B1
(45) **Date of Patent: *Dec. 7, 2010**

(54) METHOD AND APPARATUS FOR A THIN AUDIO CODEC

(76) Inventors: Marwan A. Jabri, 656 Hilary Dr., Tiburon, CA (US) 94920; Nicola Chong-White, 364 Penshurst St., Chatswood, NSW (AU) 2067; Jianwei Wang, 2700 Lincoln Village Cir., Apt. 291, Larkspur, CA (US) 94939

( * ) Notice: Subject to any disclaimer, the term of this patent is extended or adjusted under 35 U.S.C. 154(b) by 512 days.

This patent is subject to a terminal disclaimer.

(21) Appl. No.: 11/890,263

(22) Filed: Aug. 2, 2007

Related U.S. Application Data

(63) Continuation of application No. 10/688,857, filed on Oct. 17, 2003, now Pat. No. 7,254,533.

(60) Provisional application No. 60/439,366, filed on Jan. 9, 2003, provisional application No. 60/419,776, filed on Oct. 17, 2002.

(51) Int. Cl.
*G10L 19/04* (2006.01)

(52) U.S. Cl. ..... 704/219; 704/220; 704/200.1; 704/229; 704/223; 704/262

(58) Field of Classification Search ..... 704/219, 704/220, 230, 200.1, 500–504, 223, 229, 704/262, 264
See application file for complete search history.

(56) References Cited

U.S. PATENT DOCUMENTS 5,787,390 A * 7/1998 Quinquis et al. ..... 704/219
6,115,688 A * 9/2000 Brandenburg et al. ..... 704/503
6,115,689 A * 9/2000 Malvar ..... 704/503
6,167,373 A * 12/2000 Morii ..... 704/219
6,314,393 B1 11/2001 Zheng et al.
6,424,939 B1 * 7/2002 Herre et al. ..... 704/219
6,717,955 B1 4/2004 Holler
6,799,060 B1 * 9/2004 Kim ..... 455/563
6,807,524 B1 * 10/2004 Bessette et al. ..... 704/200.1
6,912,584 B2 * 6/2005 Wang et al. ..... 709/231

(Continued)

OTHER PUBLICATIONS

3GPP TS 26.073 "ANSI-C code for the Adaptive Multi Rate (AMR) speech codec", Release 5.00, (Mar. 2002) 3rd Generation Partnership Project (3GPP), http://www.3gpp2.org/.

(Continued)

*Primary Examiner*—Vijay B Chawan
(74) *Attorney, Agent, or Firm*—Hoffmann & Baron, LLP

(57) ABSTRACT

An apparatus and method for encoding and decoding a voice signal. The apparatus includes an encoder configured to generate an output bitstream signal from an input voice signal. The output bitstream signal is associated with at least a first standard of a first plurality of CELP voice compression standards. Additionally, the apparatus includes a decoder configured to generate an output voice signal from an input bitstream signal. The input bitstream signal is associated with at least a first standard of a second plurality of CELP voice compression standards. The CELP encoder includes a plurality of codec-specific encoder modules. Additionally, the CELP encoder includes a plurality of generic encoder modules. The CELP decoder includes a plurality of codec-specific decoder modules. Additionally, the CELP decoder includes a plurality of generic decoder modules.

20 Claims, 23 Drawing Sheets

U.S. PATENT DOCUMENTS

| | | | | |
|---|---|---|---|---|
| 7,254,533 | B1 * | 8/2007 | Jabri et al. | 704/219 |
| 7,539,612 | B2 * | 5/2009 | Thumpudi et al. | 704/200.1 |
| 2002/0028670 | A1 | 3/2002 | Ohsuge | |
| 2003/0103524 | A1 | 6/2003 | Hasegawa | |

OTHER PUBLICATIONS

3GPP TS 26.090, "Adaptive Multi-Rate (AMR) speech codec; Transcoding functions", Release 5.0.0 (Jun. 2002), 3rd Generation Partnership Project (3GPP), http://www.3gpp2.org/.

3GPP TS 26.104 "ANSI-C code for the floating-point AMR speech codec", Release 5.00, (Jun. 2002) 3rd Generation Partnership Project (3GPP), http://www.3gpp2.org/.

3GPP TS 26.173 "ANSI-C code for the Adaptive Multi-Rate Wideband speech codec", (Mar. 2002) 3rd Generation Partnership Project (3GPP), http://www.3gpp2.org/.

3GPP TS 26.190 "AMR Wideband speech codec; Transcoding Functions (Release 5)", 3rd Generation Partnership Project (3GPP); Dec. 2001, http://www.3gpp2.org/.

3GPP TS 26.204 "ANSI-C code for the floating-point Adaptive Multi-Rate Wideband (AMR-WB) speech codec", Release 5.0.0, (Mar. 2002) 3rd Generation Partnership Project (3GPP); http://www.3gpp2.org/.

3GPP2 C.S0030-0 "Selectable Mode Vocoder Service Option for Wideband Spread Spectrum Communication Systems", 3rd Generation Partnership Project (3GPP2), Dec. 2001, http://www.3gpp2.org/.

ANSI/TIA/EIA-136-Rev.C, part 410—"TDMA Celluar/PCS—Radio Interface, Enhance Full Rate Voice Codec (ACELP)." Formerly IS-641. TIA published standard, Jun. 1, 2001, http://www.tiaoline.org.

Cox, "Speech Coding Standards," Speech Coding and Synthesis, W.B.Kleijn et al., eds., pp. 49-78, Elsevier Science, (1995), The Netherlands.

ETSI, GSM 6.10 "Recommendation GSM 6.10 Full-Rate Speech Transcoding", version 8.02 (Nov. 2000). European Telecommunications Standards Institute (ETSI), http:IIwww.etsi.org/.

ETSI GSM 06.60, "Enhanced Full Rate (EFR) Speech transcoding" version 8.0.1 (Nov. 2000), European Telecommunications Standards Institute (ETSI), http:IIwww.etsi.org/.

ETSI GSM 06.20, "Half rate speech: Half rate speech transcoding", version 8.01 (Nov. 2000). European Telecommunications Standards Institute (ETSI), http:IIwww.etsi.org/.

ISO/IEC 14496-3 MPEG4-CELP Coder, "Information Technology—coding of Audiovisual Objects, Part3: Audio, Subpart 3: CELP", ISO/JTC 1/SC 29 N2203CELP, May 1998.

ITU-T G.723.1 "Speech Coders: Dual rate speech coder for multimedia communications transmission at 5.3 and 6.3 kbit/s", ITU-T Recommendation G.723.1 (1996), Geneva, http://www.itu.org/.

ITU-T G.723.1 Annex B "Dual rate speech coder for multimedia communications transmitting at 5.3 and 6.3 kbit/s, Annex B: Alternative specification based on floating point arithmetic", ITU-T Recommendation G.723.1—Annex B, http:IIwww.itu.org/.

ITU-T G.728 "Coding of speech at 16 kbit/s using low-delay code excited linear prediction". ITU—Recommendation G.728 (1992), Geneva, http://www.itu.org/.

ITU-T G.729 "Coding of speech at 8 kbit/s using conjugate-Structure Algebraiccode-excited.linear-prediction (CS-ACELP)", ITU-T Recommendation G.729 (1996), Geneva, http://www.itu.org/.

ITU-T G.729A "Coding of Speech at 8 kbit/s using conjugate structure algebraiccode-excited linear-prediction (CS-ACELP) Annex A: Reduced complexity 8kbit/s CS-ACELP speech codec", ITU-T Recommendation G.729—Annex A, Nov. 1996, http://www.itu.org/.

ITU-T G.729C "Annex C: Reference floating-point implementation for G.729 CSACELP 8 kbit/s speech coding", ITU-T Recommendation G.729—Annex C, Sep. 1998, http://www.itu.org/.

Spanias, A.S. "Speech Coding: A Tutorial Review", Proc. IEEE, vol. 82, No. 10, pp. 1541-1582, Oct. 1994.

TIA/EIA/IS-127-2 "Enhanced Variable Rate Codec, Speech Service Option 3 for WidebandSpread Spectrum Digital Systems" Telecommunications Industry Association 1999.

TIA/EIAIIS-733, "High Rate Speech Service Option 17 for Wideband Spread Spectrum Communication Systems", TIA published standard, Nov. 17, 1997.

* cited by examiner

900

METHOD AND APPARATUS FOR A THIN AUDIO CODEC

CROSS-REFERENCES TO RELATED APPLICATIONS

This application is a continuation of U.S. patent application Ser. No. 10/688,857, filed on Oct. 17, 2003, which claims priority to U.S. Provisional Patent Application No. 60/419,776, filed Oct. 17, 2002 and U.S. Provisional Patent Application No. 60/439,366, filed on Jan. 9, 2003, all of which are commonly assigned, and hereby incorporated by reference for all purposes.

BACKGROUND OF THE INVENTION

The present invention relates generally to telecommunication techniques. More particularly, the invention provides an encoding and decoding system and method that support a plurality of compression standards and share computational resources. Merely by way of example, the invention has been applied to Code Excited Linear Prediction (CELP) techniques, but it would be recognized that the invention has a much broader range of applicability. A further example of the invention is a multi-codec that combines two or more speech or audio codecs. A wide range of speech and/or audio codecs may be integrated within the multi-codec architecture.

Code Excited Linear Prediction (CELP) speech coding techniques are widely used in mobile telephony, voice trunking and routing, and Voice-over-IP (VoTP). Such coders/decoders (codecs) model voice signals as a source filter model. The source/excitation signal is generated via adaptive and fixed codebooks, and the filter is modeled by a short-term linear predictive coder (LPC). The encoded speech is then represented by a set of parameters which specify the filter coefficients and the type of excitation.

Industry standards codecs using CELP techniques include Global System for Mobile (GSM) Communications Enhanced Full Rate (EFR) codec, Adaptive Multi-Rate Narrowband (AMR-NB) codec, Adaptive Multi-Rate Wideband (AMR-WB), G.723.1, G.729, Enhanced Variable Rate Codec (EVRC), Selectable Mode Vocoder (SMV), QCELP, and MPEG-4. These standard codecs apply substantially the same generic algorithms in extracting CELP parameters with modifications to frame and subframe sizes, filtering procedures, interpolation resolutions, code-book structures and code-book search intervals.

For example, the GSM standards AMR-NB and AMR-WB usually operate with a 20 ms frame size divided into 4 subframes of 5 ms. One difference between the wideband and narrowband coder is the sampling rate, which is 8 kHz for AMR-NB and 16 kHz downsampled to 12.8 kHz for analysis for AMR-WB. The linear prediction (LP) techniques used in both AMR-NB and AMR-WB are substantially identical, but AMR-WB performs adaptive tilt filtering, linear prediction (LP) analysis to 16th order over an extended bandwidth of 6.4 kHz, conversion of LP coefficients to/from Immittance Spectral Pairs (ISP), and quantization of the ISPs using split-multi-stage vector quantization (SMSVQ). The pitch search routines and computation of the target signal are similar. Both codecs follow an ACELP fixed codebook structure using a depth-first tree search to reduce computations. The adaptive and fixed codebook gains are quantized in both codecs using joint vector quantization (VQ) with 4th order moving average (MA) prediction. AMR-WB also contains additional functions to deal with the higher frequency band up to 7 kHz.

In another example, the Code Division Multiple Access (CDMA) standards SMV and EVRC share certain math functions at the basic operations level. At the algorithm level, the noise suppression and rate selection routines of EVRC are substantially identical to SMV modules. The LP analysis follows substantially the same algorithm in both codecs and both modify the target signal to match an interpolated delay contour. At Rate ⅛, both codecs produce a pseudo-random noise excitation to represent the signal. SMV incorporates the full range of post-processing operations including tilt compensation, formant postfilter, long term postfilter, gain normalization, and highpass filtering, whereas EVRC uses a subset of these operations.

As discussed above, a large number of industry standards codecs use CELP techniques. These codecs are usually supported by mobile and telephony handsets in order to interoperate with emerging and legacy network infrastructure. With the deployment of media rich handsets and the increasing complexity of user applications on these handsets, the large number of codecs is putting increasing pressure on handset resources in terms of program memory and DSP resources.

Hence it is desirable to improve codec techniques.

SUMMARY OF THE INVENTION

The present invention relates generally to telecommunication techniques. More particularly, the invention provides an encoding and decoding system and method that support a plurality of compression standards and share computational resources. Merely by way of example, the invention has been applied to Code Excited Linear Prediction (CELP) techniques, but it would be recognized that the invention has a much broader range of applicability.

According to an embodiment, the present invention provides a method and apparatus for encoding and decoding a speech signal using a multiple codec architecture concept that supports several CELP voice coding standards. The individual codecs are combined into an integrated framework to reduce the program size. This integrated framework is referred to as a thin CELP codec. The apparatus includes a CELP encoder that generates a bitstream from the input voice signal in a format specific to the desired CELP codec, and a CELP decoding module that decodes a received CELP bitstream and generates a voice signal. The CELP encoder includes one or more codec-specific CELP encoding modules, a common functions library, a common math operations library, a common tables library, and a bitstream packing module. The common libraries are shared between more than one voice coding standard. The output bitstream may be bit-exact to the standard codec implementation or produce quality equivalent to the standard codec implementation. The CELP decoder includes bitstream unpacking module, one or more codec-specific CELP decoding modules, a common functions library, a common math operations library and a library of common tables. The output voice signal may be bit-exact to the standard codec implementation or produce quality equivalent to the standard codec implementation According to another embodiment, the method for encoding a voice signal includes generating CELP parameters from the input voice signal in a format specific to the desired CELP codec and packing the codec-specific CELP parameters to the output bitstream. The method for decoding a voice signal includes unpacking the bitstream into codec-specific CELP parameters, and decoding the parameters to generate output speech.

According to yet another embodiment of the present invention, an apparatus for encoding and decoding a voice signal includes an encoder configured to generate an output bitstream signal from an input voice signal. The output bitstream signal is associated with at least a first standard of a first plurality of CELP voice compression standards. Additionally, the apparatus includes a decoder configured to generate an output voice signal from an input bitstream signal. The input bitstream signal is associated with at least a first standard of a second plurality of CELP voice compression standards. The CELP encoder includes a plurality of codec-specific encoder modules. At least one of the plurality of codec-specific encoder modules including at least a first table, at least a first function or at least a first operation. The first table, the first function or the first operation is associated with only a second standard of the first plurality of CELP voice compression standards. Additionally, the CELP encoder includes a plurality of generic encoder modules. At least one of the plurality of generic encoder modules includes at least a second table, a second function or a second operation. The second table, the second function or the second operation is associated with at least a third standard and a fourth standard of the first plurality of CELP voice compression standards. The third standard and the fourth standard of the first plurality of CELP voice compression standards are different. The CELP decoder includes a plurality of codec-specific decoder modules. At least one of the plurality of codec-specific decoder modules includes at least a third table, at least a third function or at least a third operation. The third table, the third function or the third operation is associated with only a second standard of the second plurality of CELP voice compression standards. Additionally, the CELP decoder includes a plurality of generic decoder modules. At least one of the plurality of generic decoder modules includes at least a fourth table, a fourth function or a fourth operation. The fourth table, the fourth function or the fourth operation is associated with at least a third standard and a fourth standard of the second plurality of CELP voice compression standards. The third standard and the fourth standard of the second plurality of CELP voice compression standards are different.

According to yet another embodiment of the present invention, a method for encoding and decoding a voice signal includes receiving an input voice signal, processing the input voice signal, and generating an output bitstream signal based on at least information associated with the input voice signal. The output bitstream signal is associated with at least a first standard of a first plurality of CELP voice compression standards. Additionally, the method includes receiving an input bitstream signal, processing the input bitstream signal, and generating an output voice signal based on at least information associated with the input bitstream signal. The output voice signal is associated with at least a first standard of a second plurality of CELP voice compression standards. The processing the input voice signal uses at least a first common functions library, at least a first common math operations library, and at least a first common tables library. The first common functions library includes a first function; the first common math operations library includes a first operation, and the first common tables library includes a first table. The first function, the first operation and the first table are associated with at least a second standard and a third standard of the first plurality of CELP voice compression standards. The second standard and the third standard of the first plurality of CELP voice compression standards are different. The generating an output bitstream signal includes generating a first plurality of codec-specific CELP parameters based on at least information associated with the input voice signal, and packing the first plurality of codec-specific CELP parameters to the output bitstream signal. The processing the input bitstream signal uses at least a second common functions library, at least a second common math operations library, and a second common tables library. The second common functions library includes a second function, the second common math operations library includes a second operation, and the second common tables library includes a second table. The second function, the second operation and the second table are associated with at least a second standard and a third standard of the second plurality of CELP voice compression standards. The second standard and the third standard of the second plurality of CELP voice compression standards are different. The generating an output voice signal includes unpacking the input bitstream signal and decoding a second plurality of codec-specific CELP parameters to produce an output voice signal.

An example of the invention are provided, specifically a thin CELP codec which combines the voice coding standards of GSM-EFR, GSM AMR-NB and GSM AMR-WB. Another example illustrates the combination of the EVRC and SMV voice coding standards for CDMA. Many variations of voice coding standard combinations are applicable.

Numerous benefits are achieved using the present invention over conventional techniques. Certain embodiments of the present invention can be used to reduce the program size of the encoder and decoder modules to be significantly less than the combined program size of the individual voice compression modules. Some embodiments of the present invention can be used to produce improved voice quality output than the standard codec implementation. Certain embodiments of the present invention can be used to produce lower computational complexity than the standard codec implementation. Some embodiments of the present invention provide efficient embedding of a number of standard codecs and facilitates interoperability of handsets with diverse networks.

Depending upon the embodiment under consideration, one or more of these benefits may be achieved. These benefits and various additional objects, features and advantages of the present invention can be fully appreciated with reference to the detailed description and accompanying drawings that follow.

DETAILED DESCRIPTION OF SPECIFIC EMBODIMENTS

The present invention relates generally to telecommunication techniques. More particularly, the invention provides an encoding and decoding system and method that support a plurality of compression standards and share computational resources. Merely by way of example, the invention has been applied to Code Excited Linear Prediction (CELP) techniques, but it would be recognized that the invention has a much broader range of applicability.

Figure 1A:
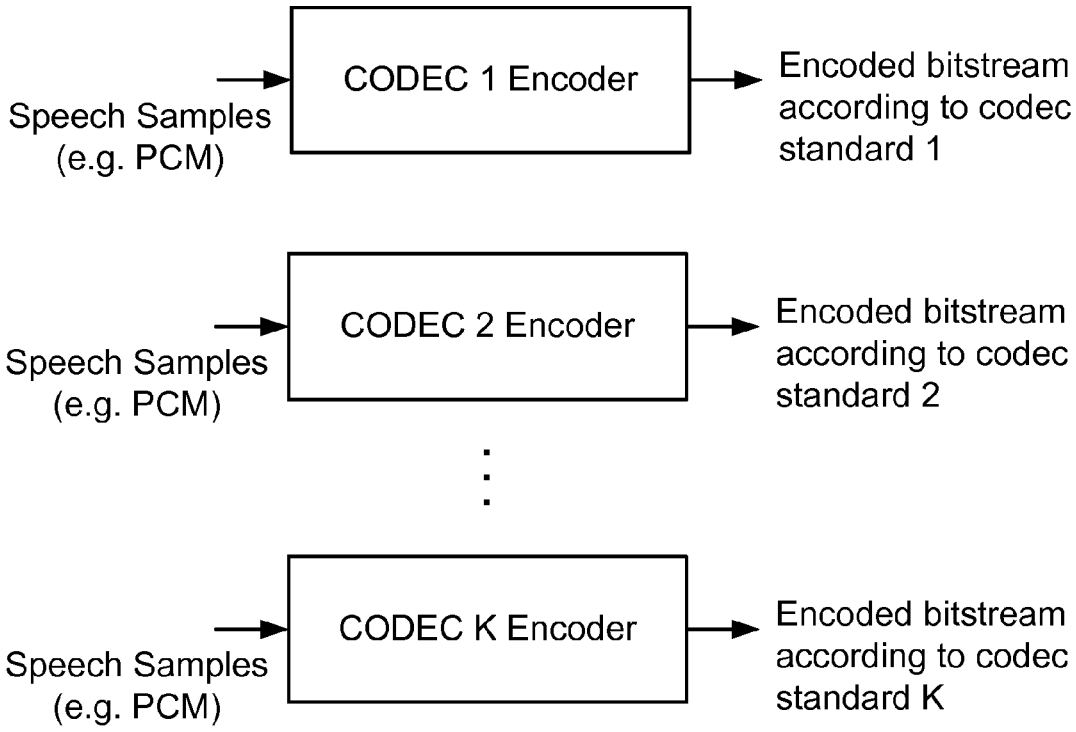
FIGS. 1A and 1B are simplified illustrations of the encoder and decoder modules for voice coding to encode to and decode from multiple voice coding standards.
Figure 1B:
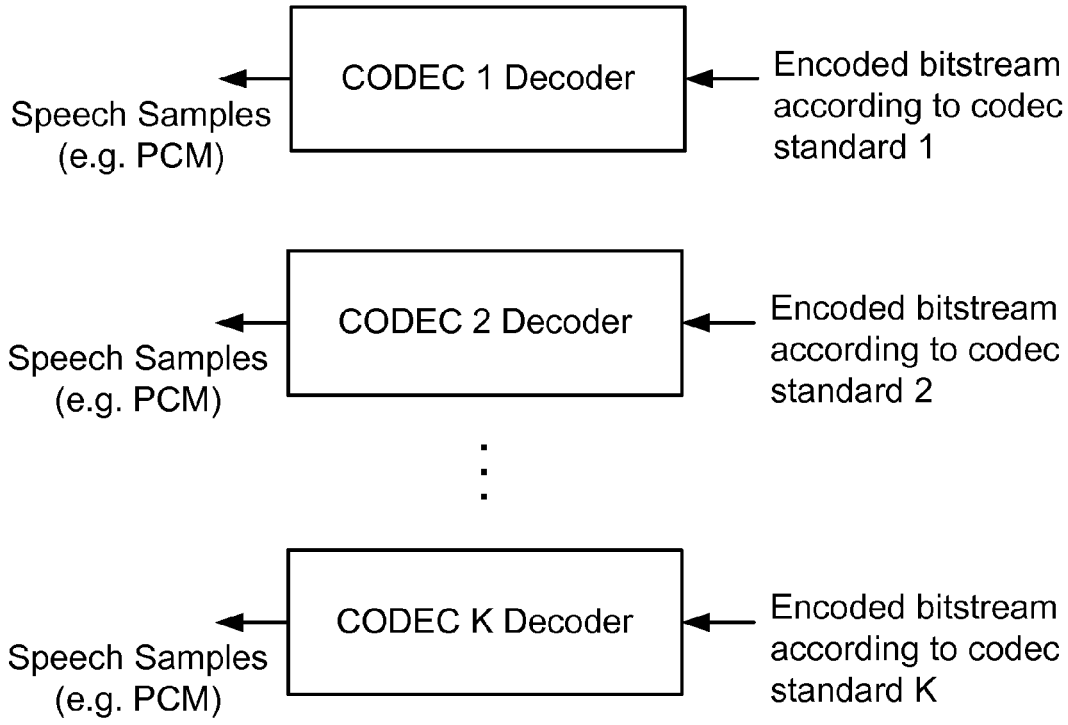

An illustration of the encoder and decoder modules for voice coding to encode to and decode from multiple voice coding standards are shown in FIG. 1A and FIG. 1B. A separate encoder and decoder may be used for each coding standard, which may lead to large combined program memory requirements. Since many voice coding standards presently used are based on the Code Excited Linear Prediction (CELP) algorithm, there are many similarities in the processing functions across different coding standards.

Figure 2:
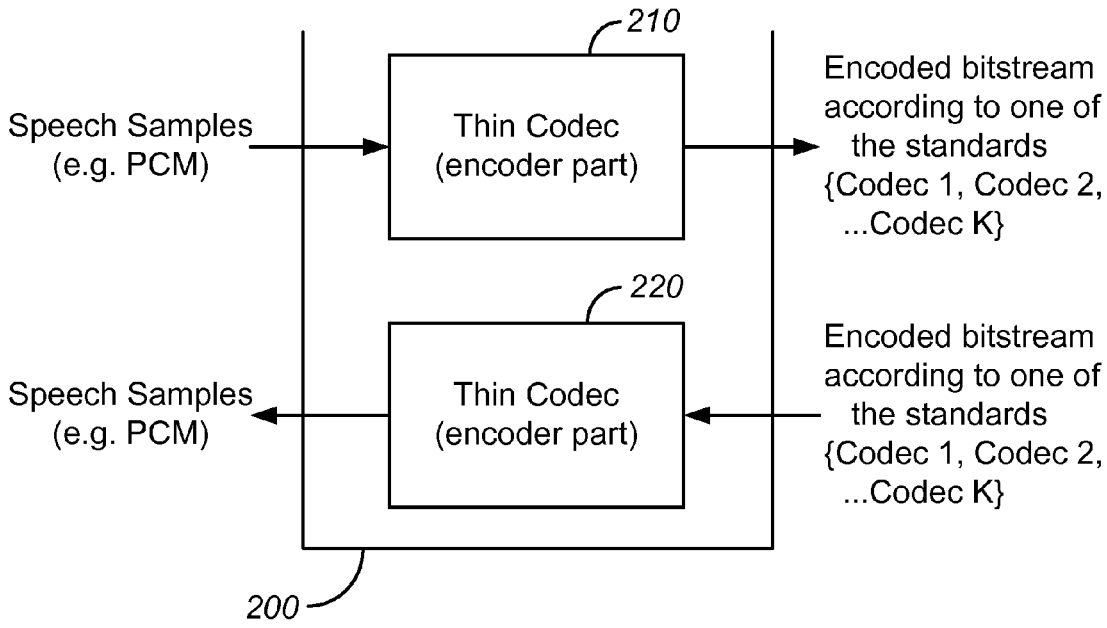
FIG. 2 is a simplified diagram for a thin codec according to one embodiment of the present invention.

FIG. 2 is a simplified diagram for a thin codec according to one embodiment of the present invention. This diagram is merely an example, which should not unduly limit the scope of the present invention. One of ordinary skill in the art would recognize many variations, alternatives, and modifications. The thin codec 200 can encode voice samples into one of several voice compression formats, and decode bitstreams in one of several voice compression formats back to voice samples. The thin codec 200 includes an encoder system 210 and a decoder system 220. The encoder system 210 can encode the input voice samples into one of several CELP voice compression formats and the decoder system 220 can decode a bitstream in one of several CELP voice compression formats back to speech samples using an integrated codec architecture.

Figure 3:
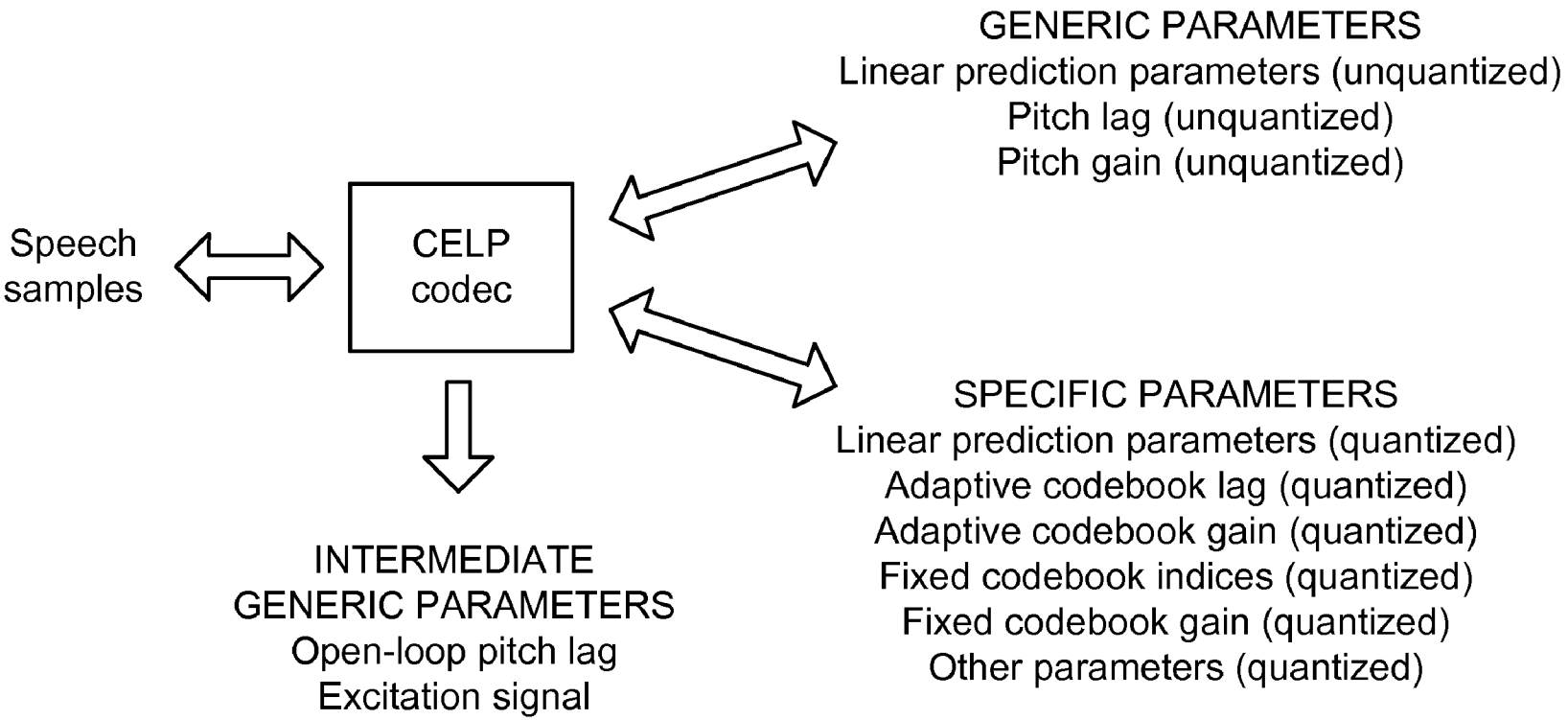
FIG. 3 is a simplified diagram for certain parameters common to some CELP codec standards according to an embodiment of the present invention.

FIG. 3 is a simplified diagram for certain parameters common to some CELP codec standards according to an embodiment of the present invention. This diagram is merely an example, which should not unduly limit the scope of the present invention. One of ordinary skill in the art would recognize many variations, alternatives, and modifications. The intermediate parameters of open-loop pitch lag and excitation signal are usually generic to CELP codecs. The unquantized values for linear prediction parameters, pitch lags, and pitch gains are also usually generic CELP parameters. The quantized values for linear prediction parameters, adaptive codebook lags, adaptive codebook gains, fixed codebook indices, fixed codebook gains and other parameters are usually considered codec-specific parameters. For example, the quantized values for linear prediction parameters include line spectral frequencies obtained from a vector-quantization codebook.

Figure 4:
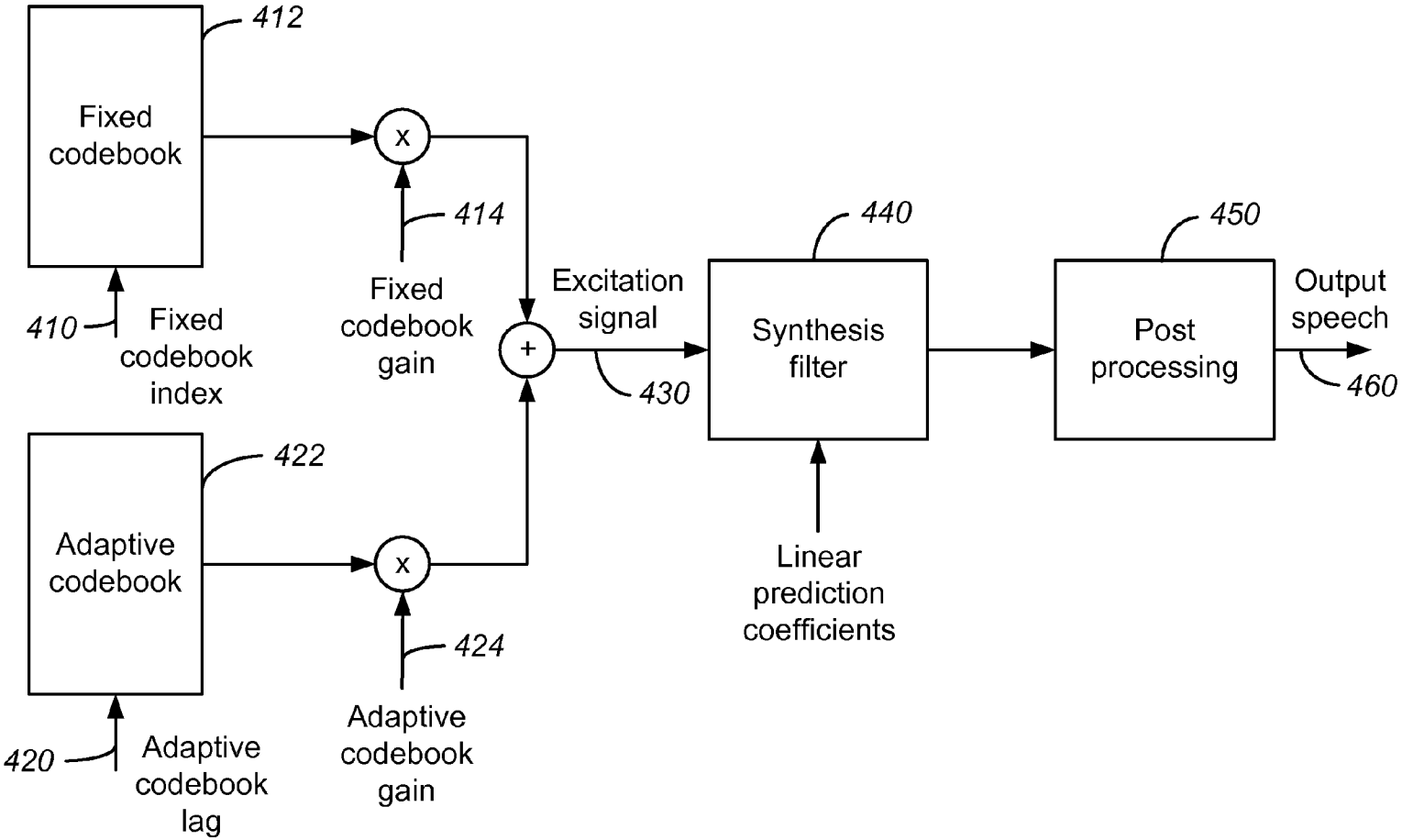
FIG. 4 is a simplified block diagram of a CELP decoder.

FIG. 4 is a simplified block diagram of a CELP decoder. A fixed codebook index 410 and an adaptive codebook lag 420 are used to extract vectors from a fixed codebook 412 and an adaptive codebook 422 respectively. The selected fixed codebook vector and adaptive codebook vector are gain-scaled using a decoded fixed codebook gain 414 and an adaptive codebook gain 424 respectively, and then added together to form an excitation signal 430. The excitation signal 430 is filtered by a linear prediction synthesis filter 440 to provide the spectral shape, and the resulting signal is post-processed by a post processing unit 450 to form an output speech 460.

Figure 5:
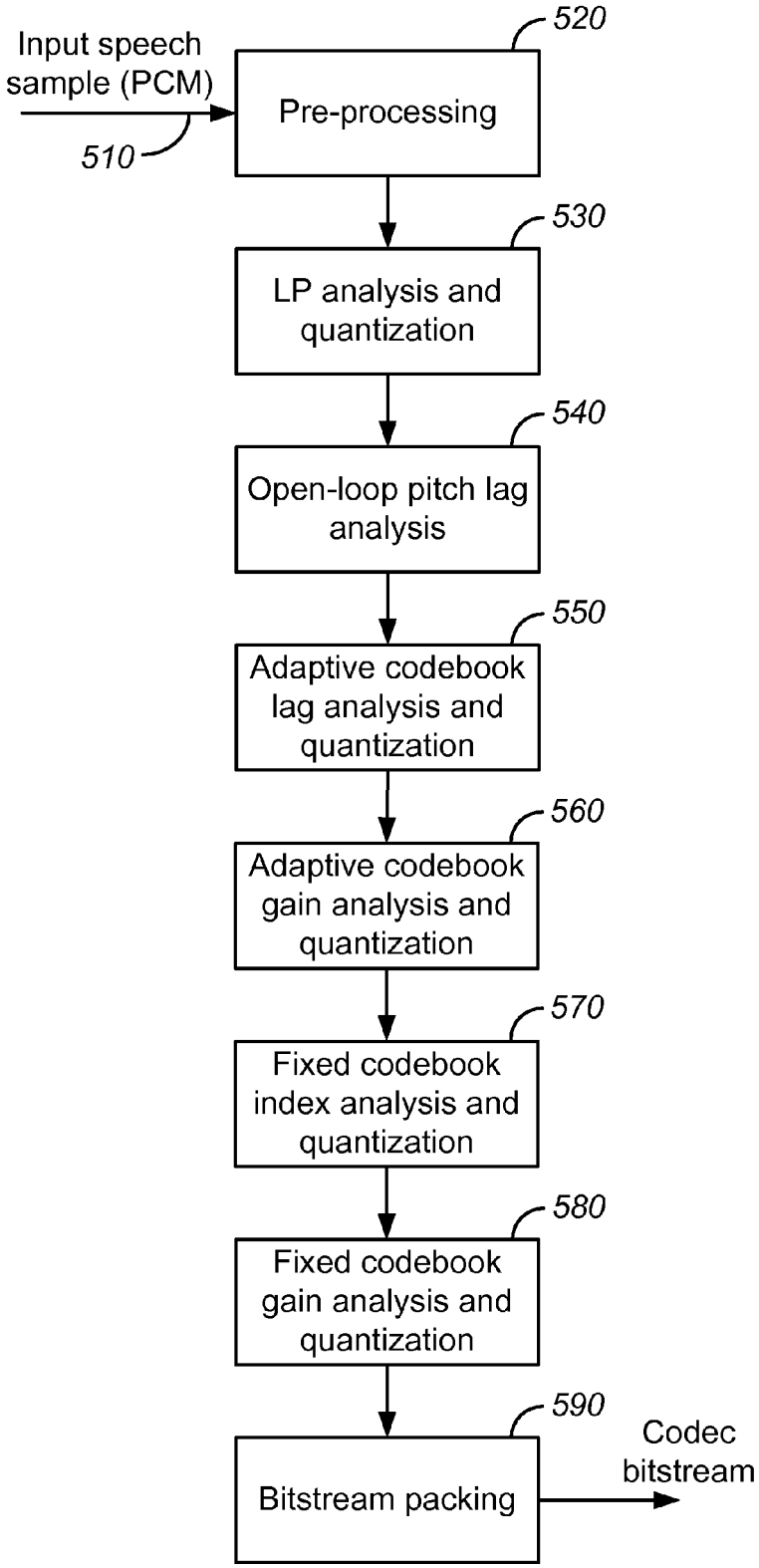
FIG. 5 is a simplified diagram for processing modules of a CELP encoder.

FIG. 5 is a simplified diagram for processing modules of a CELP encoder. An input speech sample 510 is first pre-processed by a pre-processing module 520. The output of the pre-processing module 520 is further processed by a linear prediction analysis and quantization module 530. The open-loop pitch lag, adaptive codebook lag, and adaptive codebook gain are then determined and quantized by modules 540, 550, and 560 respectively. The fixed codebook indices and fixed codebook gain are then determined and quantized by modules 570 and 580 respectively. Lastly, the bitstream is packed in a desired format by a module 590.

Figure 6:
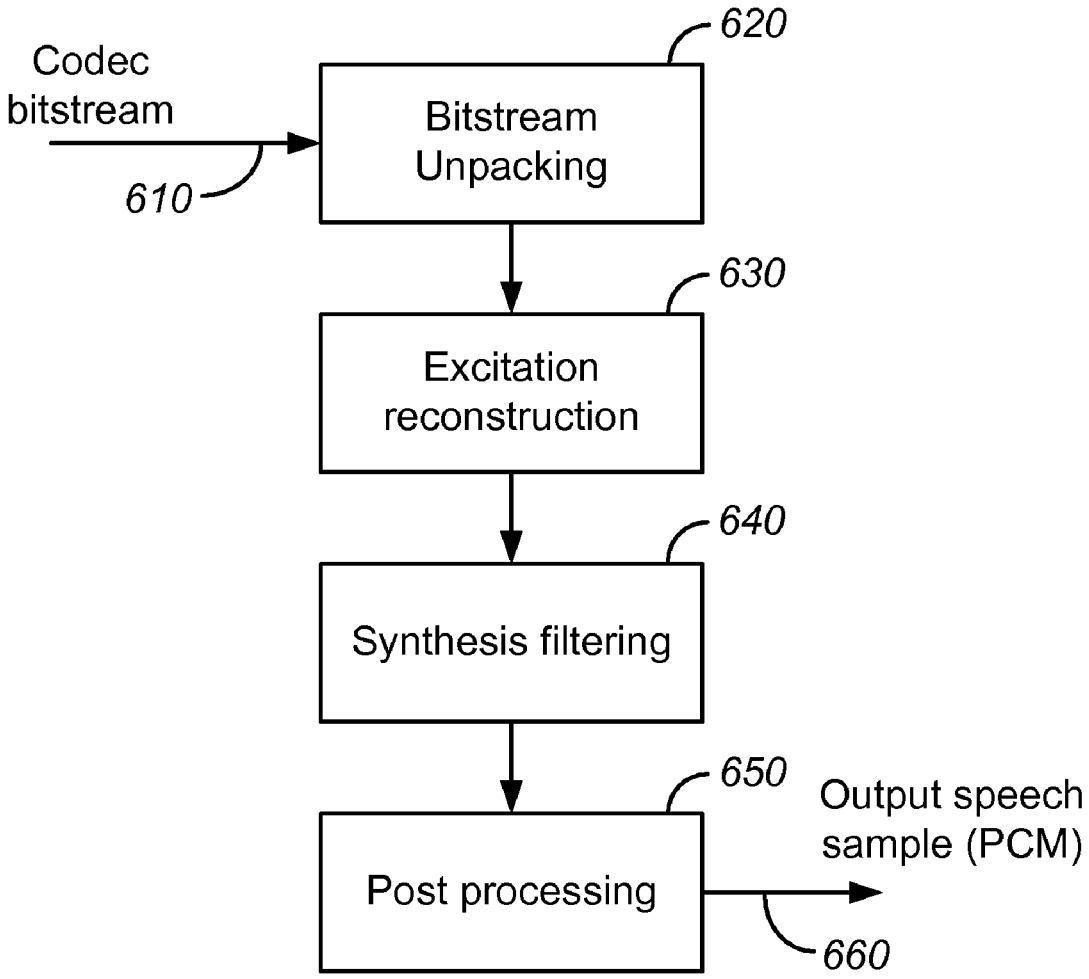
FIG. 6 is a simplified diagram for processing modules of a CELP decoder.

FIG. 6 is a simplified diagram for processing modules of a CELP decoder. A codec bitstream 610 is first unpacked to yield the CELP parameters by a module 620, and the excitation is reconstructed using the adaptive codebook parameters and fixed codebook parameters by a module 630. The excitation is then filtered by a linear prediction synthesis filter 640, and finally post-processing operations are applied by a module 650 to produce an output speech sample 660.

Figure 7:
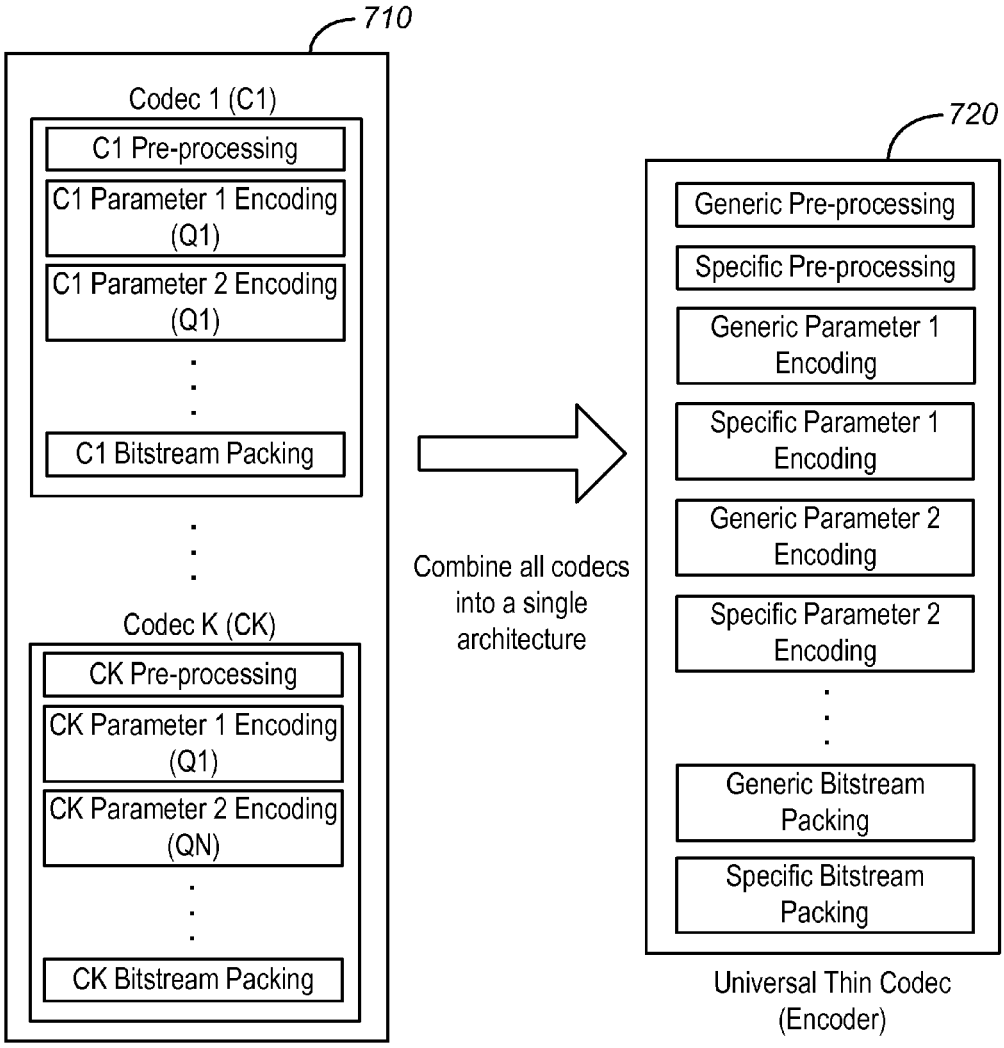
FIG. 7 is a simplified diagram comparing the structure of multiple individual encoders and the encoder part of a thin codec architecture according to one embodiment of the present invention.

FIG. 7 is a simplified diagram comparing the structure of multiple individual encoders and the encoder part of a thin codec architecture according to one embodiment of the present invention. This diagram is merely an example, which should not unduly limit the scope of the present invention. One of ordinary skill in the art would recognize many variations, alternatives, and modifications. In the thin codec architecture, individual encoders 710 are integrated into a combined codec architecture 720. Each processing module of the encoders 710 is factorized into a generic part and a specific part in the combined codec architecture 720. The program memory for the generic coding part can be shared between several voice coding standards, resulting in smaller overall program size. Depending on the bitstream constraints, the number of codecs combined, and the similarity between the codecs combined, the encoder part 720 of the thin codec may achieve significant program size reductions. The bitstream constraints may include bit-exactness and minimum performance requirements.

Figure 8:
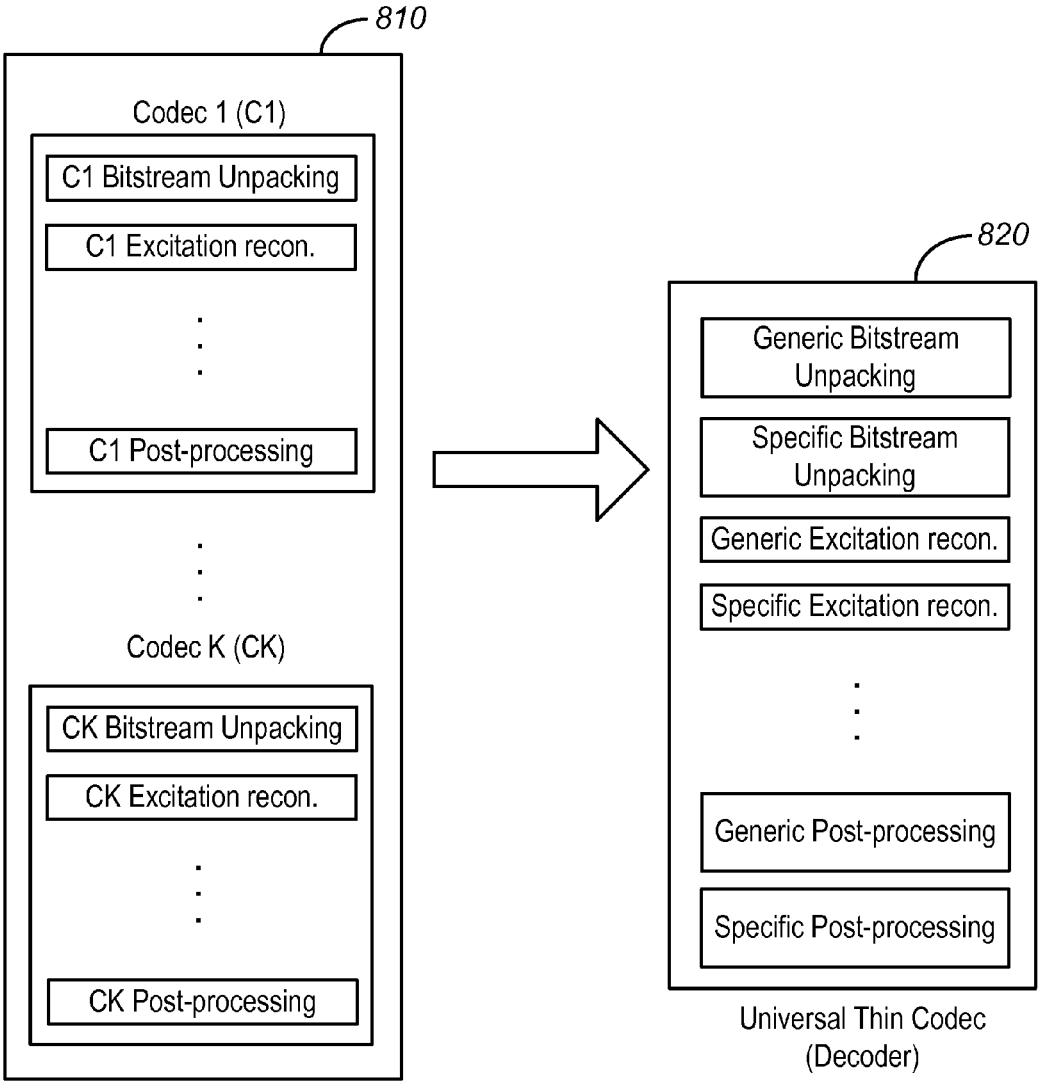
FIG. 8 is a simplified diagram comparing the structure of multiple individual decoders and the decoder part of a thin codec architecture according to one embodiment of the present invention.

FIG. 8 is a simplified diagram comparing the structure of multiple individual decoders and the decoder part of a thin codec architecture according to one embodiment of the present invention. This diagram is merely an example, which should not unduly limit the scope of the present invention. One of ordinary skill in the art would recognize many variations, alternatives, and modifications. In the thin codec architecture, individual decoders are integrated into a combined codec architecture 820. Each processing module of the decoders 810 is factorized into a generic part and a specific part. The program memory for the generic decoding part can be shared between several voice coding standards, resulting in smaller overall program size. Depending on the bitstream constraints, the number of codecs combined, and the similarity between the codecs combined, the decoder part 820 of the thin codec may achieve significant program size reductions. The bitstream constraints may include bit-exactness and minimum performance requirements.

Figure 9:
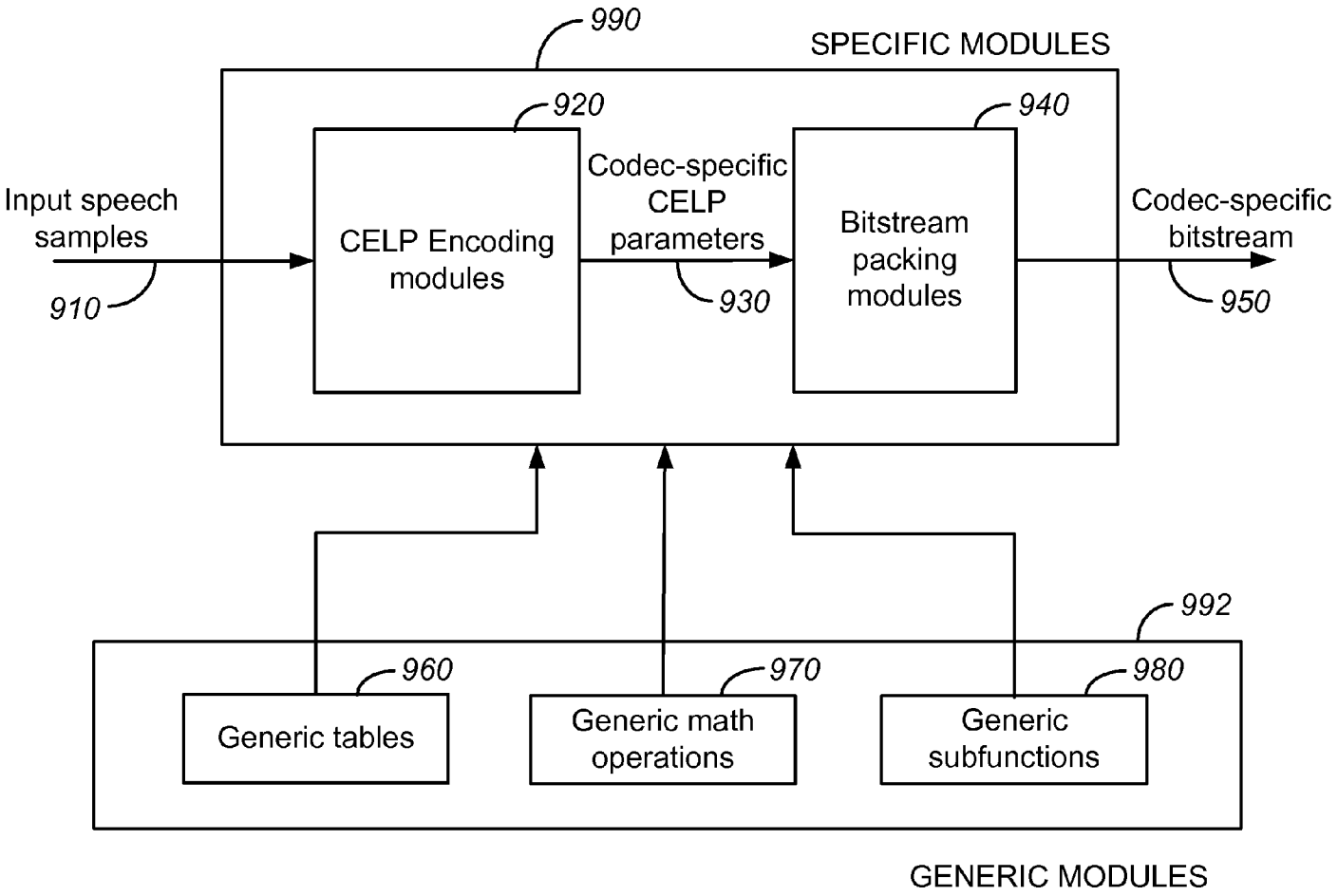
FIG. 9 is a simplified block diagram for an encoder of a thin CELP codec according to an embodiment of the present invention.

FIG. 9 is a simplified block diagram for an encoder of a thin CELP codec according to an embodiment of the present invention. This diagram is merely an example, which should not unduly limit the scope of the present invention. One of ordinary skill in the art would recognize many variations, alternatives, and modifications.

An encoder 900 of a thin CELP codec includes specific modules 990 and generic modules 992. The specific modules 990 include CELP encoding modules 920 and bitstream packing modules 940. The generic modules 992 include generic tables 960, generic math operations 970, and generic subfunctions 980. Input speech samples 910 are input to the codec-specific CELP encoding modules 920 and codec-specific CELP parameters 930 are produced. These parameters are then packed to a bitstream 950 in a desired coding standard format using the codec-specific bitstream packing modules 940. The codec-specific CELP encoding modules 920 contain encoding modules for each supported voice coding standard. However, the tables 960, math operations 970 and subfunctions 980 that are common or generic to two or more of the supported encoders are factored out of the individual encoding modules by a codec algorithm factorization module, and included only once in a shared library in the thin codec 900. This sharing of common code reduces the combined program memory requirements. Algorithm factorization is performed only once during the implementation stage for each combination of codecs in the thin codec. Efficient factorizing of subfunctions may require splitting the processing modules into more than one stage. Some stages may share commonality with other codecs, while other stages may be distinct to a particular codec.

Figure 10:
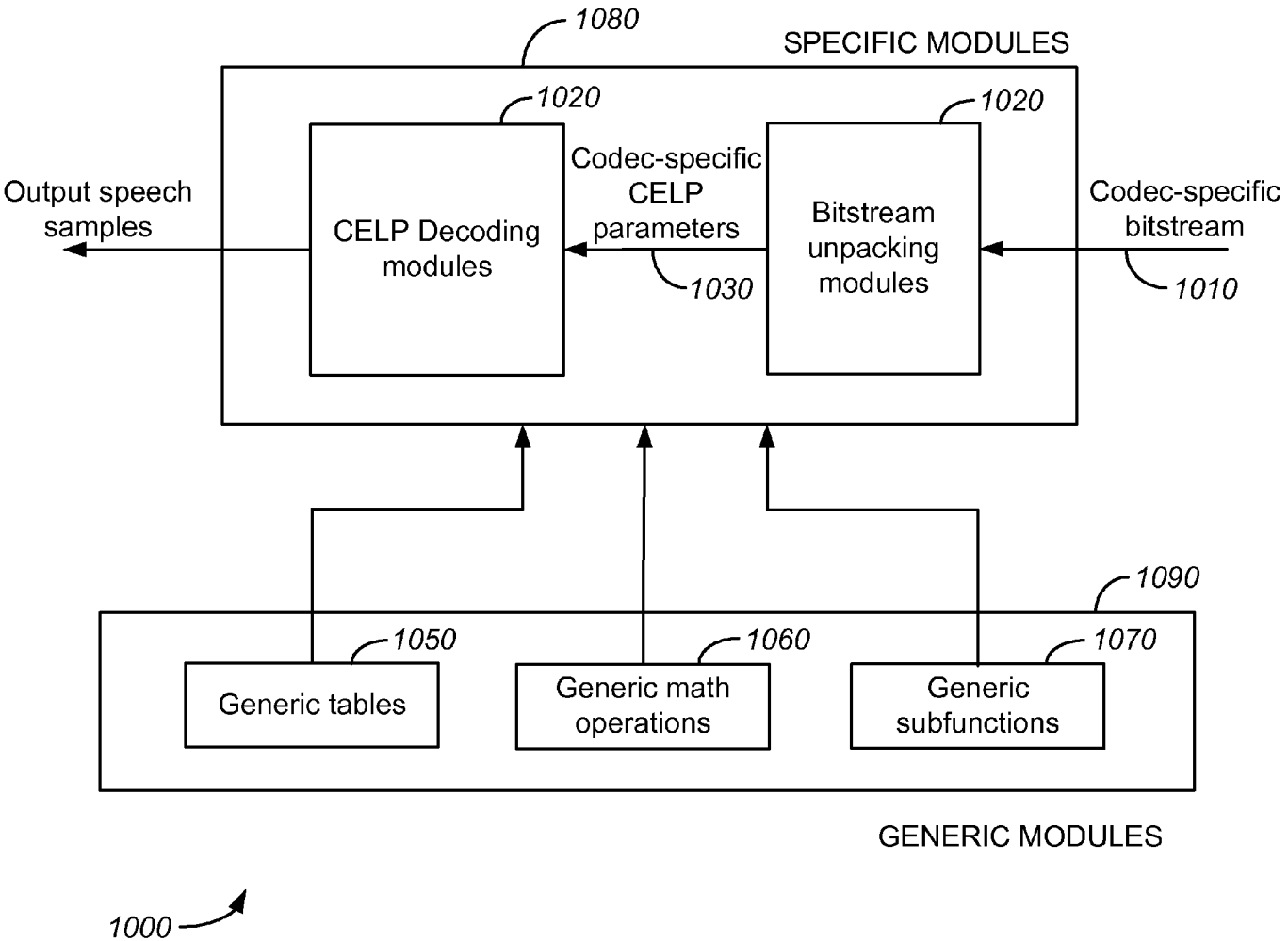
FIG. 10 is a simplified block diagram for a decoder of a thin CELP codec according to an embodiment of the present invention.

FIG. 10 is a simplified block diagram for a decoder of a thin CELP codec according to an embodiment of the present invention. This diagram is merely an example, which should not unduly limit the scope of the present invention. One of ordinary skill in the art would recognize many variations, alternatives, and modifications. A decoder 1000 of a thin CELP codec includes specific modules 1080 and generic modules 1090. The specific modules 1080 include bitstream unpacking modules 1020 and CELP decoding modules 1040. The generic modules 1090 includes generic tables 1050, generic math operations 1060, and generic subfunctions 1070. A codec-specific bitstream 1010 is unpacked by the bitstream unpacking modules 1020, which contain a bitstream unpacking routine for each supported voice coding standard, and codec-specific CELP parameters 1030 are output to the CELP decoding modules 1040. The tables 1050, math operations 1060 and subfunctions 1070 that are common or generic to more than two of the supported decoders are factored out of the codec-specific CELP decoding modules and included in a shared library.

Figure 11A:
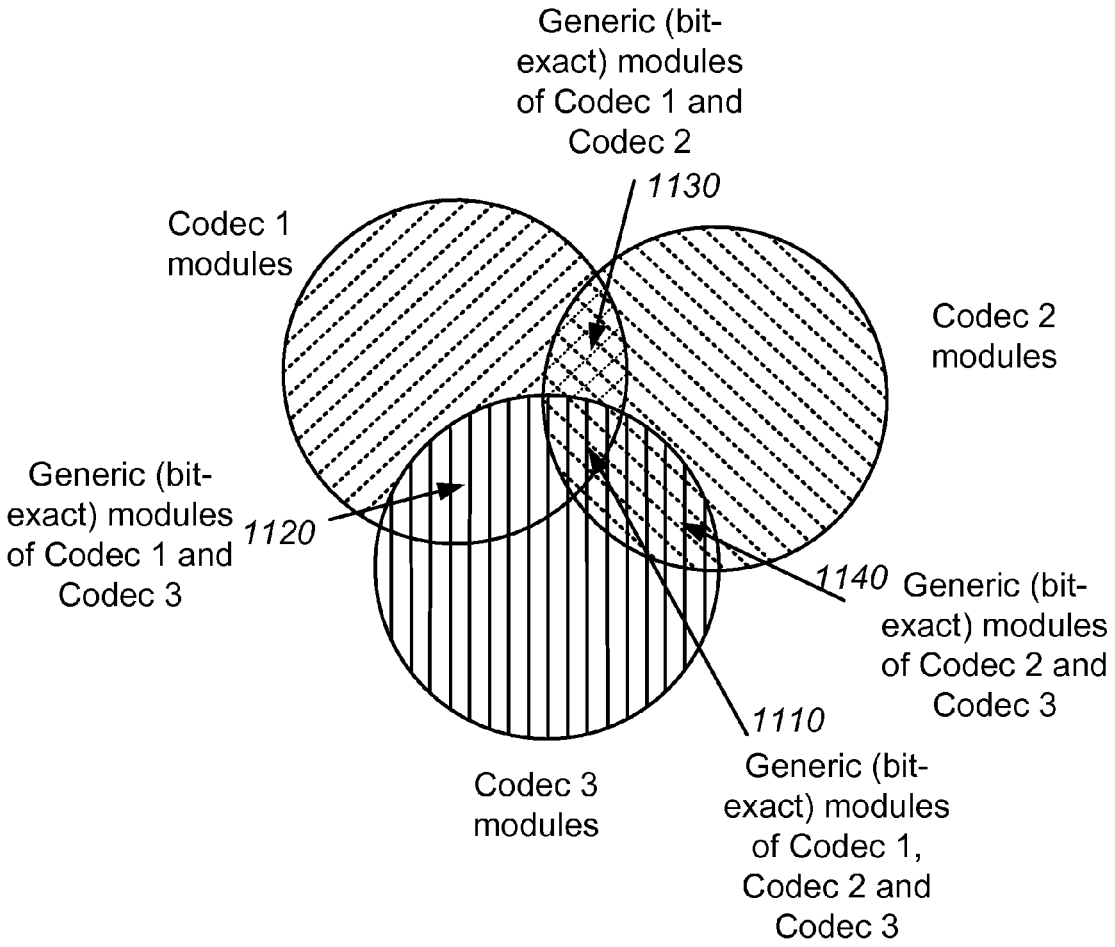
FIG. 11A is a simplified diagram showing generic modules between codec 1, codec 2 and code 3 for bit-exact implementation according to an embodiment of the present invention.

The algorithm factorization module can operate at a number of levels depending on the codec requirements. If a bit-exact implementation is required to the individual standard codecs, only functions, tables, and math operations that maintain bit-exactness between more than two codecs are factored out into the generic modules. FIG. 11A is a simplified diagram showing generic modules between codec 1, codec 2 and code 3 for bit-exact implementation according to an embodiment of the present invention. This diagram is merely an example, which should not unduly limit the scope of the present invention. One of ordinary skill in the art would recognize many variations, alternatives, and modifications. An area 1110 represents generic bit-exact modules of codecs 1, 2, and 3. Areas 1120, 1130, and 1140 represent generic bit-exact modules of codecs 1 and 3, codecs 1 and 2, and codec 2 and 3 respectively.

Figure 11B:
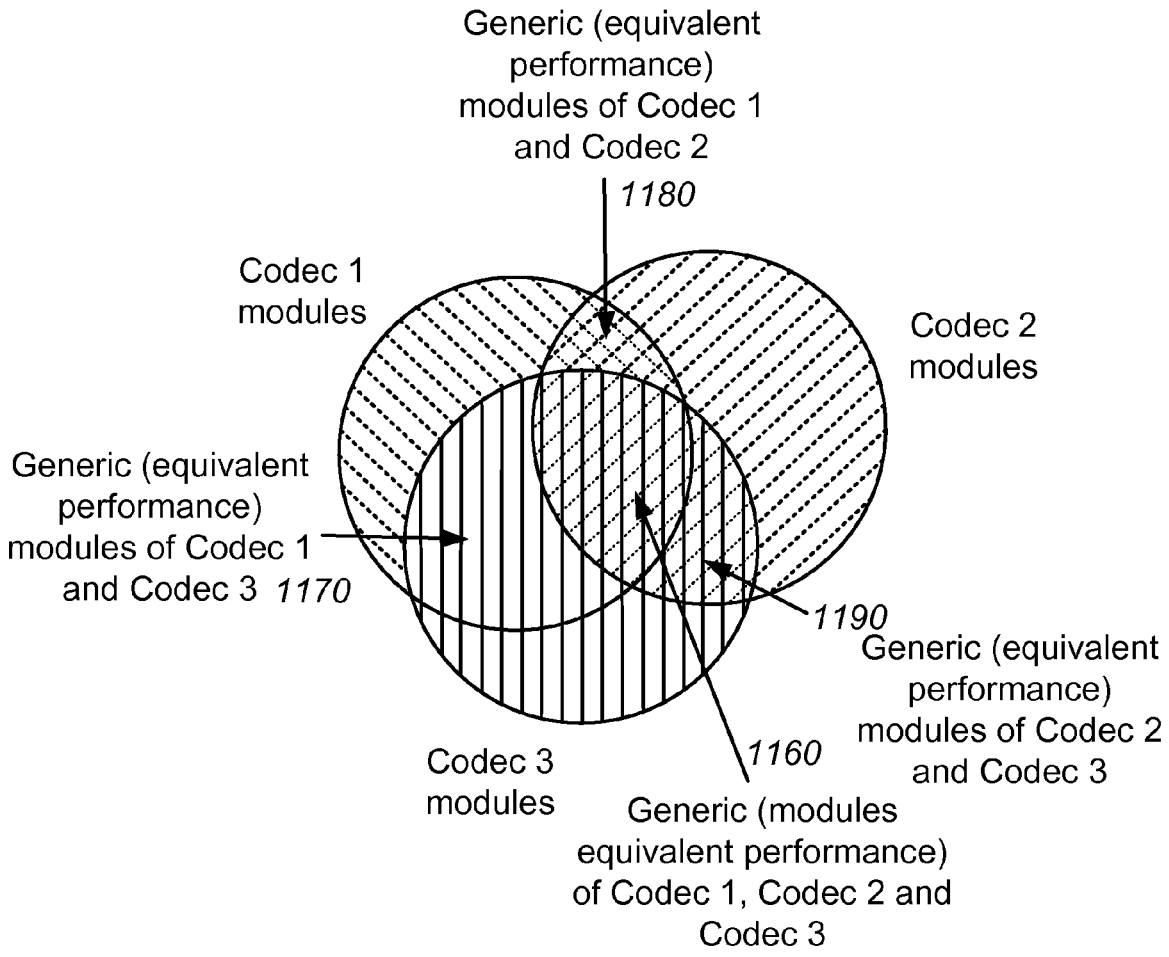
FIG. 11B is a simplified diagram showing generic modules between codec 1, codec 2 and code 3 for equivalent performance implementation according to an embodiment of the present invention.

If the bit-exact constraint is relaxed, then functions, tables and math operations that produce equivalent quality or provide equivalent functionality can be factored out into the generic modules. Alternatively, new generic processing modules can be derived and called by one or more codecs. This has the benefit of providing bit-compliant codec implementation. Using this approach, the program size can be reduced even further by having an increased number of generic modules. FIG. 11B is a simplified diagram showing generic modules between codec 1, codec 2 and code 3 for equivalent performance implementation according to an embodiment of the present invention. This diagram is merely an example, which should not unduly limit the scope of the present invention. One of ordinary skill in the art would recognize many variations, alternatives, and modifications. An area 1160 represents generic bit-exact modules of codecs 1, 2, and 3. Areas 1170, 1180, and 1190 represent generic bit-exact modules of codecs 1 and 3, codecs 1 and 2, and codec 2 and 3 respectively. For example, the area 1160 is larger than the area 1110, so more generic modules can be used in equivalent performance than in bit-exact implementation.

It is beneficial to maintain a modular, generalized framework so that modules for additional coders can be easily integrated. The use of generic modules may provide output voice quality higher than the standard codec implementation without an increase in program complexity, for example, by applying more advanced perceptual weighting filters. The use of generic modules may also provide lower complexity than the standard codec, for example, by applying faster searching techniques. These benefits may be combined.

The greater the similarity between voice coding standards, the greater the program size savings that can be achieved by a thin codec according to an embodiment of the present invention. As an example for illustration of the bit-compliant specific embodiment of a thin CELP codec, the speech codecs integrated are GSM-EFR, AMR-NB and AMR-WB, although others can be used. GSM-EFR is algorithmically the same as the highest rate of AMR-NB, thus no additional program code is required for AMR-NB to gain GSM-EFR bit-compliant functionality. The GSM standards AMR-NB, which has eight modes ranging from 4.75 kbps to 12.2 kbps, and AMR-WB, which has eight modes ranging from 6.60 kbps to 23.85 kbps, share a high degree of similarity in the encoder/decoder flow and in the general algorithms of many procedures.

According to one embodiment of the present invention, an apparatus for encoding and decoding a voice signal includes an encoder configured to generate an output bitstream signal from an input voice signal. The output bitstream signal is associated with at least a first standard of a first plurality of CELP voice compression standards. Additionally, the apparatus includes a decoder configured to generate an output voice signal from an input bitstream signal. The input bitstream signal is associated with at least a first standard of a second plurality of CELP voice compression standards. The output bitstream signal is bit exact or equivalent in quality for the first standard of the first plurality of CELP voice compression standards.

The CELP encoder includes a plurality of codec-specific encoder modules. At least one of the plurality of codec-specific encoder modules including at least a first table, at least a first function or at least a first operation. The first table, the first function or the first operation is associated with only a second standard of the first plurality of CELP voice compression standards. Additionally, the CELP encoder includes a plurality of generic encoder modules. At least one of the plurality of generic encoder modules includes at least a second table, a second function or a second operation. The second table, the second function or the second operation is associated with at least a third standard and a fourth standard of the first plurality of CELP voice compression standards. The third standard and the fourth standard of the first plurality of CELP voice compression standards are different.

The plurality of codec-specific encoder modules includes a pre-processing module configured to process the speech for encoding, a linear prediction analysis module configured to generate linear prediction parameters, an excitation generation module configured to generate an excitation signal by filtering the input speech signal by the short-term prediction filter, and a long-term prediction module configured to generate open-loop pitch lag parameters. Additionally, the plurality of codec-specific encoder modules includes an adaptive codebook module configured to determine an adaptive codebook lag and an adaptive codebook gain, a fixed codebook module configured to determine fixed codebook vectors and a fixed codebook gain; and a bitstream packing module. The bitstream packing module includes at least one bitstream packing routine and is configured to generate the output bitstream signal based on at least codec-specific CELP parameters associated with at least the first standard of the first plurality of CELP voice compression standards.

The plurality of generic encoder modules comprises a first common functions library including at least the second function, a first common math operations library including at least the second operation, and a first common tables library including at least the second table. The first common functions library, the first common math operations library and the first common tables library are made by at least an algorithm factorization module. The algorithm factorization module is configured to remove a first plurality of generic functions, a first plurality of generic operations and a first plurality of generic tables from the plurality of codec-specific encoder modules and store the first plurality of generic functions, the first plurality of generic operations and the first plurality of generic tables in the first common functions library, the first common math operations library and the first common tables library.

The first common functions library, the first common math operations library and the first common tables library are associated with at least the third standard and the fourth standard of the first plurality of CELP voice compression standards and configured to substantially remove all duplications between a first program code associated with the third standard of the first plurality of CELP voice compression standards and a second program code associated with the fourth standard of the first plurality of CELP voice compression standards.

For example, the first common functions library, the first common math operations library and the first common tables library include only functions, math operations and tables configured to maintain bit exactness for the third standard and the fourth standard of the first plurality of CELP voice compression standards. For another example, the first common functions library, the first common math operations library and the first common tables library include only functions, math operations and tables algorithmically identical to ones of the third standard and the fourth standard of the first plurality of CELP voice compression standards, and functions, math operations and tables algorithmically similar to ones of the third standard and the fourth standard of the first plurality of CELP voice compression standards.

The CELP decoder includes a plurality of codec-specific decoder modules. At least one of the plurality of codec-specific decoder modules includes at least a third table, at least a third function or at least a third operation. The third table, the third function or the third operation is associated with only a second standard of the second plurality of CELP voice compression standards. Additionally, the CELP decoder includes a plurality of generic decoder modules. At least one of the plurality of generic decoder modules includes at least a fourth table, a fourth function or a fourth operation. The fourth table, the fourth function or the fourth operation is associated with at least a third standard and a fourth standard of the second plurality of CELP voice compression standards. The third standard and the fourth standard of the second plurality of CELP voice compression standards are different.

The plurality of codec-specific decoder modules include a bitstream unpacking module. The bitstream unpacking module includes at least one bitstream unpacking routine and is configured to decode the input bitstream signal and generate codec-specific CELP parameters. Additionally, the plurality of codec-specific decoder modules include an excitation reconstruction module configured to reconstruct an excitation signal based on at least information associated with adaptive codebook lags, adaptive codebook gains, fixed codebook indices and fixed codebook gains. Moreover, the plurality of codec-specific decoder modules include a synthesis module configured to filter the excitation signal and generate a reconstructed speech. Also, the plurality of codec-specific decoder modules include a post-processing module configured to improve a perceptual quality of the reconstructed speech.

The generic decoder modules comprise a second common functions library including at least the fourth function, a second common math operations library including at least the fourth operation, and a second common tables library including at least the fourth table. The second common functions library, the second common math operations library and the second common tables library are made by at least an algorithm factorization module. The algorithm factorization module is configured to remove a second plurality of generic functions, a second plurality of operations and a second plurality of tables from the plurality of codec-specific decoder modules and store the second plurality of generic functions, the second plurality of operations and the second plurality of tables in the second common functions library, the second common math operations library and the second common tables library.

The second common functions library, the second common math operations library and the second common tables library are associated with at least the third standard and the fourth standard of the second plurality of CELP voice compression standards and configured to substantially remove all duplications between a third program code associated with the third standard of the second plurality of CELP voice compression standards and a fourth program code associated with the fourth standard of the second plurality of CELP voice compression standards.

For example, the second common functions library, the second common math operations library and the second common tables library include only functions, math operations and tables configured to maintain bit exactness for the third standard and the fourth standard of the second plurality of CELP voice compression standards. For another example, the second common functions library, the second common math operations library and the second common tables library include only functions, math operations and tables algorithmically identical to ones of the third standard and the fourth standard of the second plurality of CELP voice compression standards, and functions, math operations and tables algorithmically similar to ones of the third standard and the fourth standard of the second plurality of CELP voice compression standards.

As discussed above and further emphasized here, one of ordinary skill in the art would recognize many variations, alternatives, and modifications. For example, the first plurality of CELP voice compression standards may be different from or the same as the second plurality of CELP voice compression standards. The first standard of the first plurality of CELP voice compression standards may be different from or the same as the first standard of the second plurality of CELP voice compression standards. The first standard of the first plurality of CELP voice compression standards may be different from or the same as the second standard of the first plurality of CELP voice compression standards. The first standard of the first plurality of CELP voice compression standards may be different from or the same as the third standard or the fourth standard of the first plurality of CELP voice compression standards. The first standard of the second plurality of CELP voice compression standards may be different from or the same as the second standard of the second plurality of CELP voice compression standards. The apparatus of claim 1 wherein the first standard of the second plurality of CELP voice compression standards is the same as the third standard or the fourth standard of the second plurality of CELP voice compression standards.

According to another embodiment of the present invention, a method for encoding and decoding a voice signal includes receiving an input voice signal, processing the input voice signal, and generating an output bitstream signal based on at least information associated with the input voice signal. The output bitstream signal is associated with at least a first standard of a first plurality of CELP voice compression standards. Additionally, the method includes receiving an input bitstream signal, processing the input bitstream signal, and generating an output voice signal based on at least information associated with the input bitstream signal. The output voice signal is associated with at least a first standard of a second plurality of CELP voice compression standards. The output bitstream signal is bit exact or equivalent in quality for the first standard of the first plurality of CELP voice compression standards. The output voice signal is bit exact or equivalent in quality for the first standard of the second plurality of CELP voice compression standards. For example, the first plurality of CELP voice compression standards include GSM-EFR, GSM-AMR Narrowband, and GSM-AMR Wideband. As another example, the first plurality of CELP voice compression standards includes EVRC and SMV.

The processing the input voice signal uses at least a first common functions library, at least a first common math operations library, and at least a first common tables library. The first common functions library includes a first function; the first common math operations library includes a first operation, and the first common tables library includes a first table. The first function, the first operation and the first table are associated with at least a second standard and a third standard of the first plurality of CELP voice compression standards. The second standard and the third standard of the first plurality of CELP voice compression standards are different. The first common functions library, the first common math operations library and the first common tables library are made by at least an algorithm factorization module. The algorithm factorization module is configured to store a first plurality of generic functions, a first plurality of operations and a first plurality of tables in the first common functions library, the first common math operations library and the first common tables library.

The generating an output bitstream signal includes generating a first plurality of codec-specific CELP parameters based on at least information associated with the input voice signal, and packing the first plurality of codec-specific CELP parameters to the output bitstream signal. The first plurality of codec-specific CELP parameters include a linear prediction parameter, an adaptive codebook lag, an adaptive codebook gain, a fixed codebook index, and a fixed codebook gain. For example, the linear prediction parameter includes a line spectral frequency. The generating a first plurality of code-specific CELP parameters includes performing a linear prediction analysis, generating linear prediction parameters, and filtering the input speech signal by a short-term prediction filter. Additionally, the generating a first plurality of code-specific CELP parameters includes generating an excitation signal, determining an adaptive codebook pitch lag parameter, and determining an adaptive codebook gain parameter. Moreover, the generating a first plurality of code-specific CELP parameters includes determining an index of a fixed codebook vector associated with a fixed codebook target signal, and determining a gain of the fixed codebook vector.

The processing the input bitstream signal uses at least a second common functions library, at least a second common math operations library, and a second common tables library. The second common functions library includes a second function, the second common math operations library includes a second operation, and the second common tables library includes a second table. The second function, the second operation and the second table are associated with at least a second standard and a third standard of the second plurality of CELP voice compression standards. The second standard and the third standard of the second plurality of CELP voice compression standards are different.

The generating an output voice signal includes unpacking the input bitstream signal and decoding a second plurality of codec-specific CELP parameters to produce an output voice signal. The decoding a second plurality of codec-specific CELP parameters includes reconstructing an excitation signal, synthesizing the excitation signal, and generating an intermediate speech signal. Additionally, the decoding a second plurality of codec-specific CELP parameters includes processing the intermediate speech signal to improve a perceptual quality.

As discussed above and further emphasized here, one of ordinary skill in the art would recognize many variations, alternatives, and modifications. For example, the first plurality of CELP voice compression standards may be different from or the same as the second plurality of CELP voice compression standards. The first standard of the first plurality of CELP voice compression standards is different from or the same as the first standard of the second plurality of CELP voice compression standards. The first standard of the first plurality of CELP voice compression standards may be different from or the same as the second standard or the third standard of the first plurality of CELP voice compression standards. The first standard of the second plurality of CELP voice compression standards may be different from or the same as the second standard or the third standard of the second plurality of CELP voice compression standards.

Figure 12:
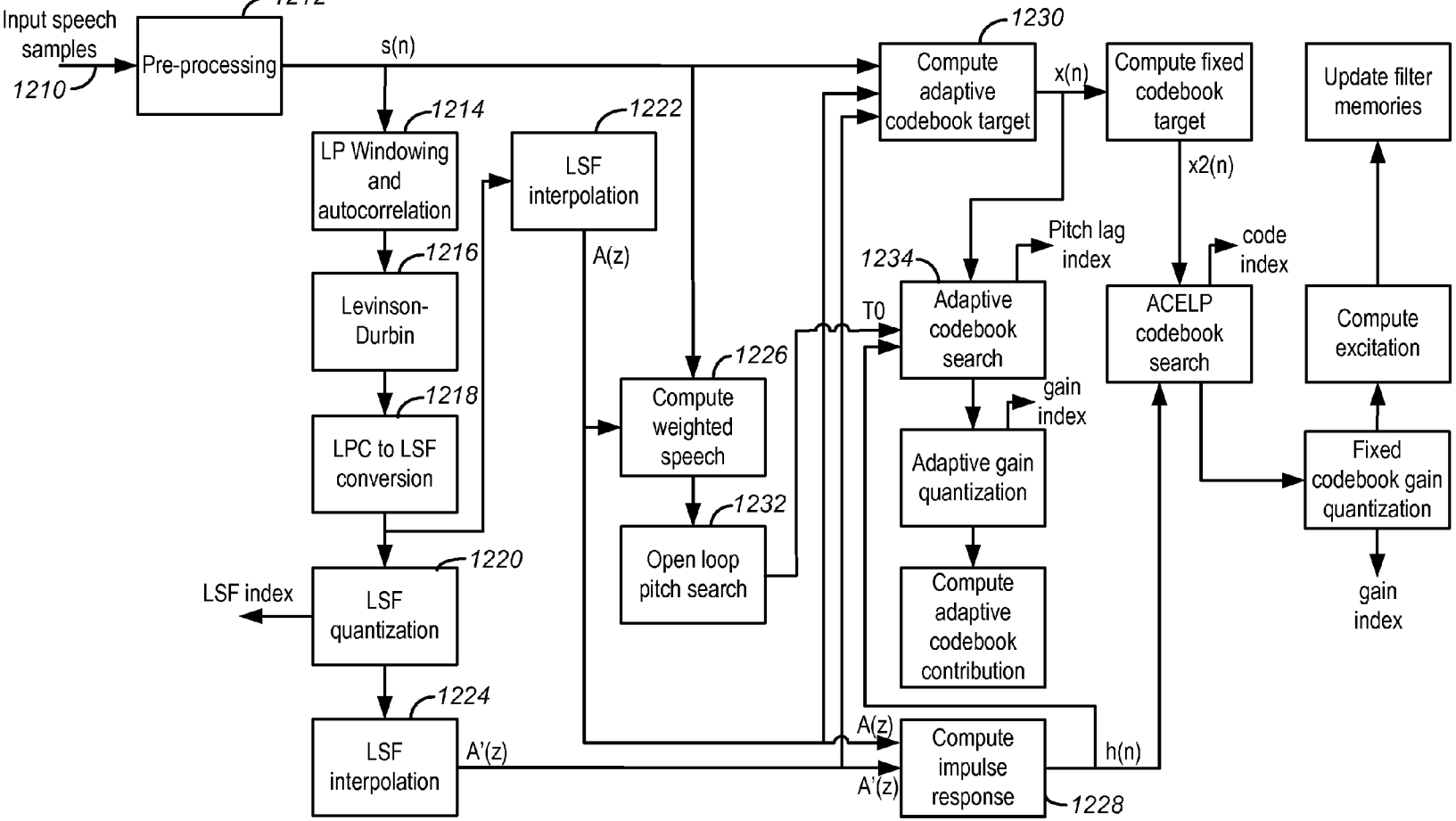
FIG. 12 is a simplified block diagram of an encoder for GSM-EFR and AMR-NB.

FIG. 12 is a simplified block diagram of an encoder for GSM-EFR and AMR-NB. GSM-EFR is algorithmically substantially the same as the highest rate of AMR-NB. Input speech samples 1210 is first preprocessed by a pre-processing module 1212, and $10^{th}$-order linear prediction coefficients are determined once per frame or twice per frame for 12.2 kbps mode by an LP windowing and autocorrelation module 1214 and a Levinson-Durbin module 1216. The Levinson-Durbin module 1216 uses the Levinson-Durbin algorithm. These $10^{th}$-order linear prediction coefficients are converted to line spectral frequencies (LSFs) by an LPC to LSF conversion module 1218. The converted frequencies are quantized by an LSF quantization module 1220. The unquantized LSFs are interpolated by an LSF interpolation module 1222, and the quantized LSFs are interpolated by an LSF interpolation module 1224. These interpolated outputs are used in the computation of the weighted speech, impulse response and adaptive codebook target by modules 1226, 1228 and 1230 respectively. The open-loop pitch is determined from the weighted speech by a module 1232 and then refined during the adaptive codebook search by a module 1234. The impulse response is computed and used in both the adaptive and fixed codebook searches. Once the adaptive lag is found, the adaptive codebook gain is determined, followed by the fixed codebook target, fixed codebook indices and fixed codebook gain. An ACELP fixed codebook structure is applied for all modes. The codebook vectors are chosen by minimizing the error between the original signal and the synthesized speech using a perceptually weighted distortion measure.

Figure 13:
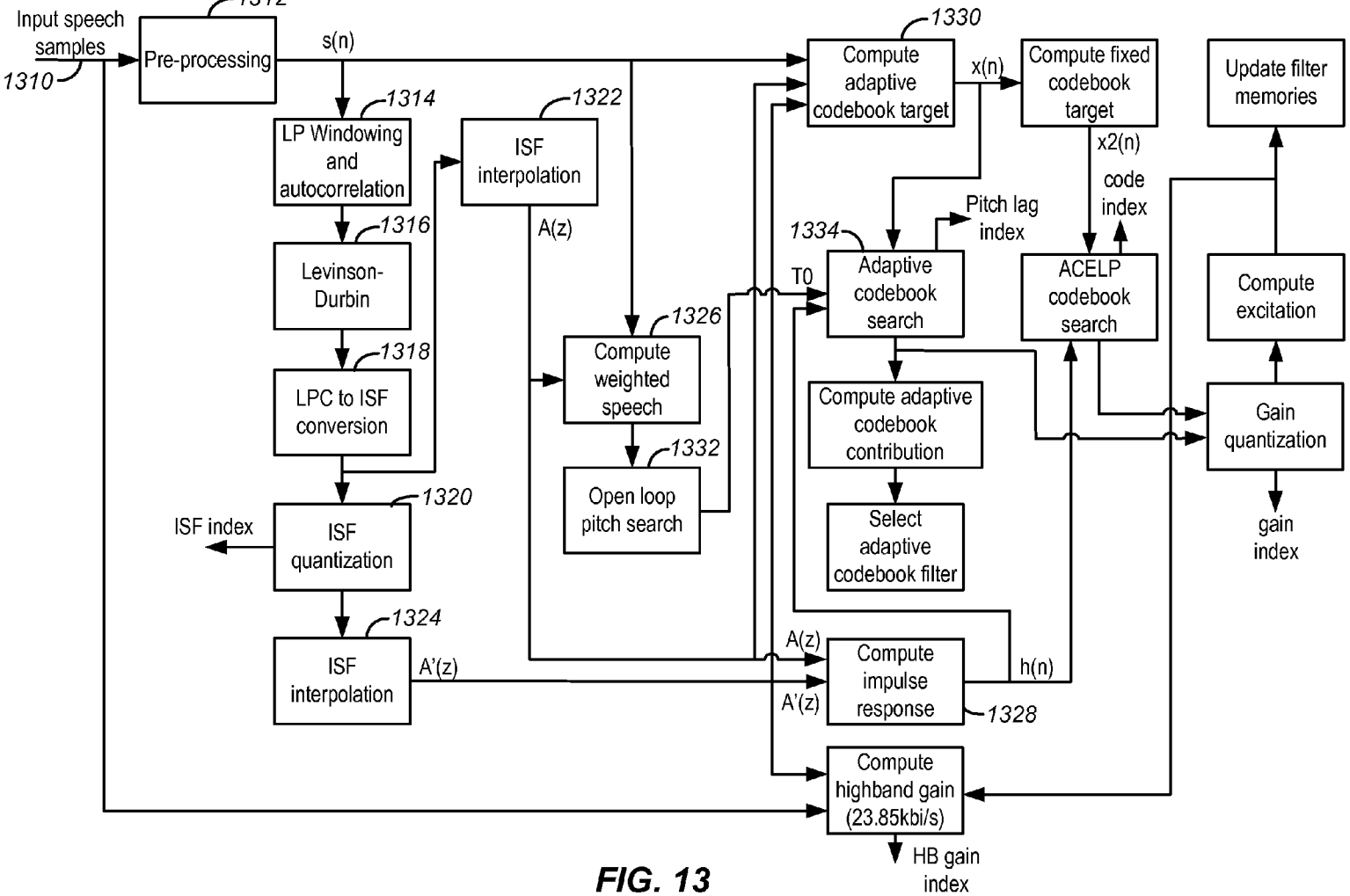
FIG. 13 is a simplified block diagram of an encoder for GSM AMR-WB.

FIG. 13 is a simplified block diagram of an encoder for GSM AMR-WB. The encoder structure has a high degree of similarity to the AMR-NB structure. Input speech samples 1310 is first preprocessed in a pre-processing module 1312. The $16^{th}$-order linear prediction coefficients (LPCs) are determined once per frame using the Levinson-Durbin algorithm by an LP windowing and autocorrelation module 1314 and a Levinson-Durbin module 1316. The LPCs are converted to immittance spectral frequencies (ISFs) by an LPC to ISF conversion module 1318. The converted frequencies are quantized by an ISF quantization module 1320. The unquantized ISFs are interpolated by an ISF interpolation module 1322, and the quantized ISFs are interpolated by an ISF interpolation module 1324. These interpolated outputs are used in the computation of the weighting filter, impulse response and adaptive codebook target by modules 1326, 1328 and 1330. The open-loop pitch is determined from the weighted speech by a module 1332 and then refined during the adaptive codebook search by a module 1334. The impulse response is computed and used in both the adaptive and fixed codebook searches. One of two interpolation filters is selected for the fractional adaptive codebook search. Once the adaptive lag is found, the adaptive codebook gain is determined, followed by the fixed codebook target, fixed codebook indices and fixed codebook gain. An ACELP fixed codebook structure is applied for all modes. The codebook vectors are chosen by minimizing the error between the original signal and the synthesized speech using a perceptually weighted distortion measure. For a high rate, the gain of the high frequency range is determined and a gain index is transmitted.

A comparison of certain features and processing functions of AMR-NB and AMR-WB according to an embodiment of the present invention is shown in Table 1. This table is merely an example, which should not unduly limit the scope of the present invention. One of ordinary skill in the art would recognize many variations, alternatives, and modifications.

TABLE 1

| | AMR-NB | AMR-WB |
|---|---|---|
| Frame size | 20 ms | 20 ms |
| Subframes per frame | 4 | 4 |
| Sampling rate | 8 kHz | 16 kHz |
| Pre-processing | Highpass filtering (80 Hz) | Upsample by 4, LPF 6.4 kHz, Downsample by 5<br>Highpass filtering (50 Hz)<br>Pre-emphasis filter H(z) = 1 − 0.68z−1 |
| LP analysis | $10^{th}$ order LP analysis<br>LPC to LSP conversion | $16^{th}$ order LP analysis<br>LPC to ISP conversion |
| LP param. | Quantize LSFs | Quantize ISPs |
| Quant. | Split matrix quantization (SMQ) or Split Vector Quantization (SVQ) | Split Multi-stage vector quantization, 2 stages |
| Weighting filter | W(z) = A(z/γ1)/A(z/γ2) | W(z) = A(z/γ1)/(1 − 0.68z−1) |
| Open-loop pitch | Pitch lag range 18-143<br>Use 3 ranges or weighting function | Pitch lag range 17-115<br>Use a weighting function |
| Closed-loop pitch | Adaptive codebook<br>Range 17, 19-143<br>⅙, ⅓ sample resolution | Adaptive codebook<br>Range 34-231<br>½, ¼ sample resolution |

TABLE 1-continued

| | AMR-NB | AMR-WB |
|---|---|---|
| Fixed codebook structure and search | ACELP, 40 samples/subframe<br>Different tracks and no. of pulses for each mode.<br>adaptive prefilter $F(z) = 1/(1 - g_p z^{-T})$ | ACELP, 64 samples/subframe<br>Different no. of pulses for each mode<br>adaptive prefilter<br>$F(z) = 1/(1 - 0.85 z^{-T})(1 - b_1 z^{-1})$ |
| Gain quantization | Joint VQ with $4^{th}$ order MA prediction or Separate quantization of codebook gain and pitch gain | Joint VQ with $4^{th}$ order MA prediction |
| High band frequency | n/a | Transmit high-band gain for highest rate<br>Generate 6.4-7 kHz with scaled white noise, convert to speech domain. |
| Post-processing | Adaptive tilt compensation filter<br>Formant postfilter<br>Highpass filtering | Highpass filtering<br>De-emphasis filter<br>Upsample by 5, Downsample by 4 |

As shown in Table 1, both AMR-NB and AMR-WB operate with a 20 ms frame size divided into 4 subframes of 5 ms. A difference between the wideband and narrowband coder is the sampling rate, which is 8 kHz for AMR-NB and 16 kHz downsampled to 12.8 kHz for analysis for AMR-WB. AMR wideband contains additional pre-processing functions for decimation and pre-emphasis. The linear prediction (LP) techniques used in both AMR-NB and AMR-WB are substantially identical, but AMR-WB performs linear prediction (LP) analysis to 16th order over an extended bandwidth of 6.4 kHz and converts the LP coefficients to/from Immittance Spectral Pairs (ISP). Quantization of the ISPs is performed using split-multi-stage vector quantization (SMSVQ), as opposed to split matrix quantization and split vector quantization for quantization of the LSFs in AMR-NB. The pitch search routines and computation of the target signal are similar, although the sample resolution for pitches differs. Both codecs follow an ACELP fixed codebook structure using a depth-first tree search to reduce computations. The adaptive and fixed codebook gains are quantized in both codecs using joint vector quantization (VQ) with 4th order moving average (MA) prediction. AMR-NB also uses scalar gain quantization for some modes. AMR-WB contains additional functions to deal with the higher frequency band up to 7 kHz. The post-processing for both coders includes high-pass filtering, with AMR-NB including specific functions for adaptive tilt-compensation and formant postfiltering, and AMR-WB including specific functions for de-emphasis and up-sampling.

Figure 14:
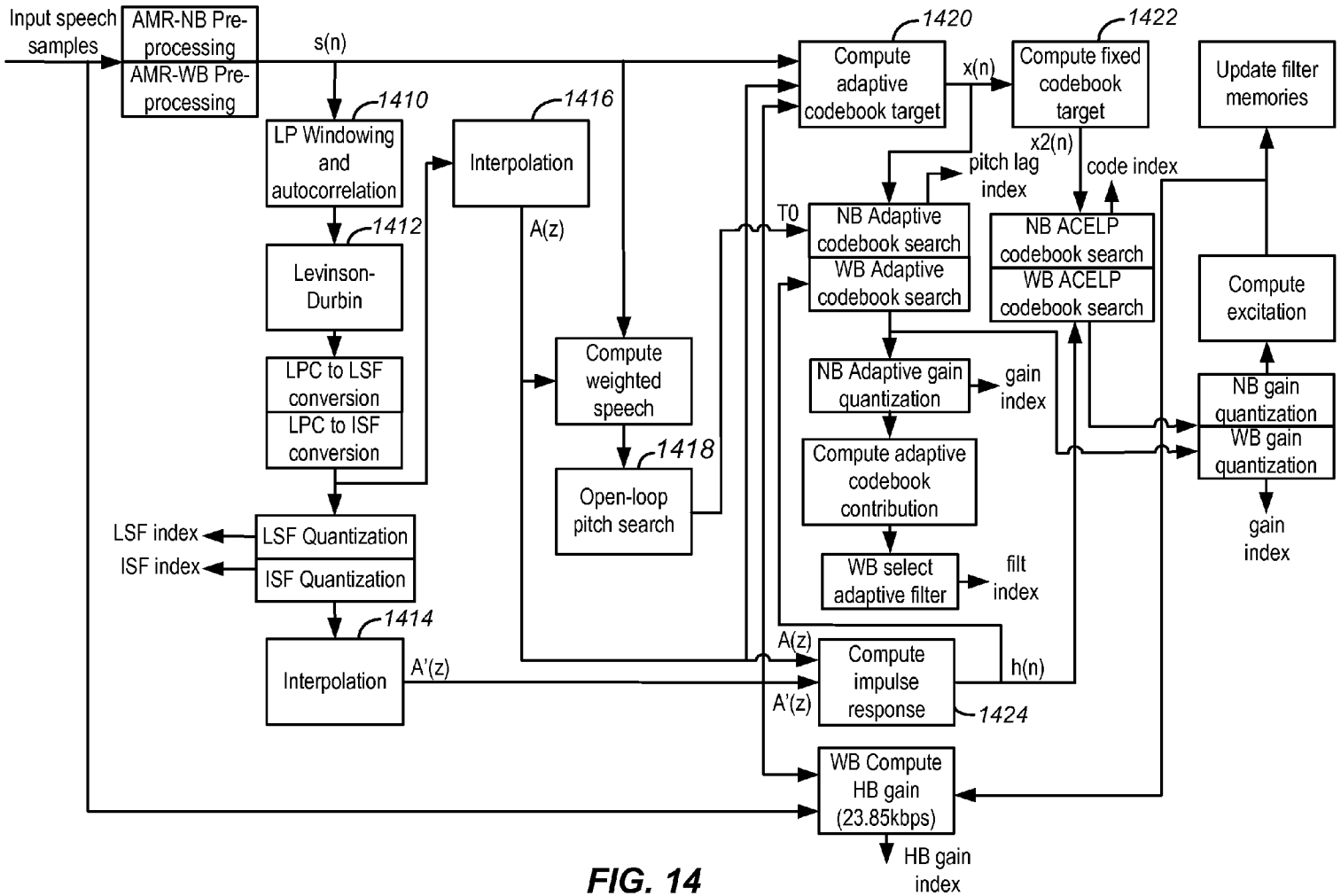
FIG. 14 is a simplified block diagram for an encoder of a thin codec for GSM-EFR, AMR-NB and AMR-WB according to an embodiment of the present invention.

FIG. 14 is a simplified block diagram for an encoder of a thin codec for GSM-EFR, AMR-NB and AMR-WB according to an embodiment of the present invention. This diagram is merely an example, which should not unduly limit the scope of the present invention. One of ordinary skill in the art would recognize many variations, alternatives, and modifications. Modules 1410 and 1412 for LP analysis, modules 1414 and 1416 for interpolation, a module 1418 for open-loop pitch search, modules 1420 and 1422 for adaptive and fixed target computation respectively, and a module 1424 for impulse response computation have a high degree of similarity and can be generic without substantial loss of quality. The modules 1410 and 1412 for LP analysis may include a module 1410 for autocorrelation and a module 1412 for Levinson-Durbin. The modules of computing weighted speech, closed-loop pitch search, ACELP codebook search, search and construct excitation also contain similarity in the processing, although conditions and parameters may vary. For example, the search methods for the ACELP fixed codebook can be shared, but the algebraic structures differ. The quantization modules are mostly codec-specific and the high-band processing functions are usually used only by AMR-WB.

Figure 15:
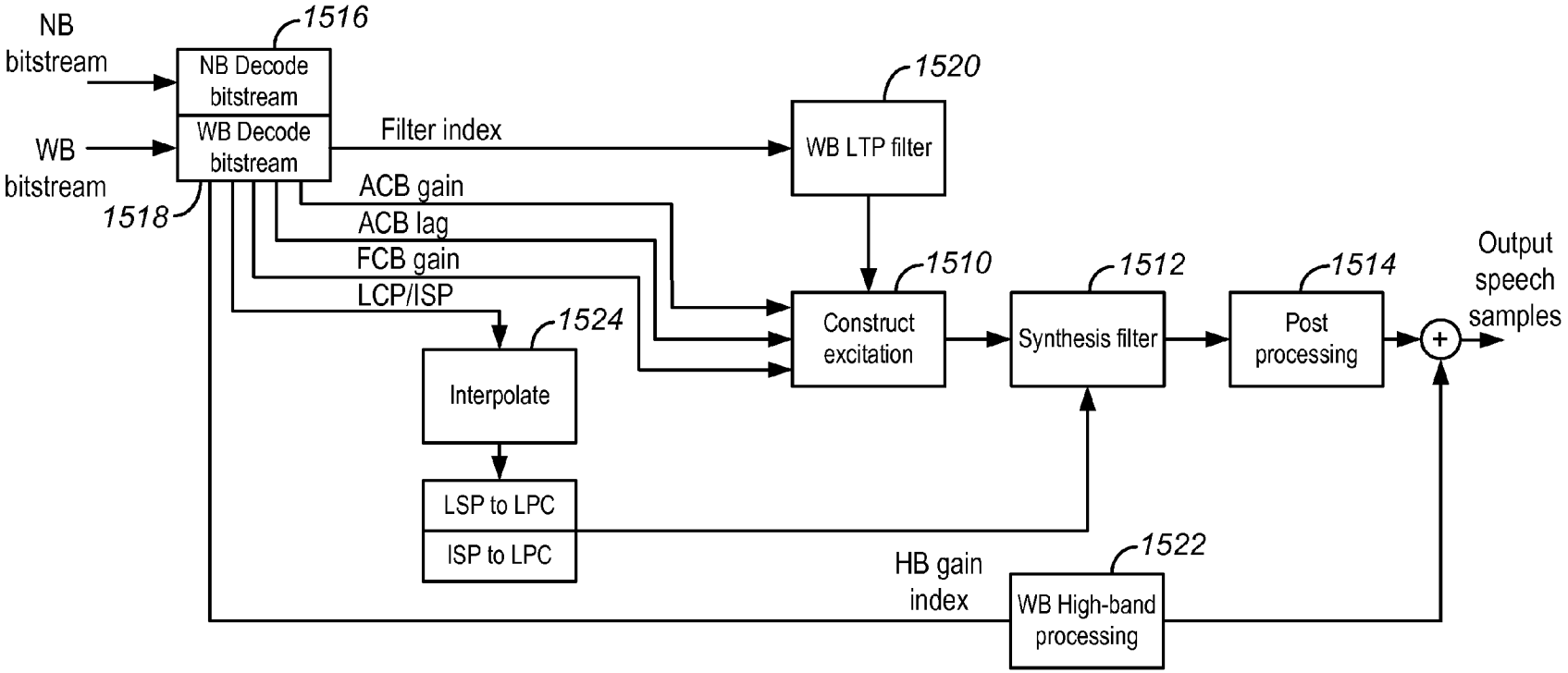
FIG. 15 is a simplified block diagram for an decoder of a thin codec for GSM-EFR, AMR-NB and AMR-WB according to an embodiment of the present invention.

FIG. 15 is a simplified block diagram for an decoder of a thin codec for GSM-EFR AMR-NB and AMR-WB according to an embodiment of the present invention. This diagram is merely an example, which should not unduly limit the scope of the present invention. One of ordinary skill in the art would recognize many variations, alternatives, and modifications. Modules 1524, 1510, 1512, and 1514 for interpolation, excitation reconstruction, synthesis and post-processing respectively have a high degree of similarity and can be generic without substantial loss of quality. Bitstream decoding modules 1516 and 1518 are codec-specific. The adaptive codebook filter 1520 and high-band processing functions 1522 are usually used only for AMR-WB. At least some generic modules are shared between the codecs. Additionally, common tables, subfunctions and operations of codec-specific modules are also factorized out into a shared library to further reduce the program size.

Embodiment

Multi-Codec for GSM Codecs

Figure 20:
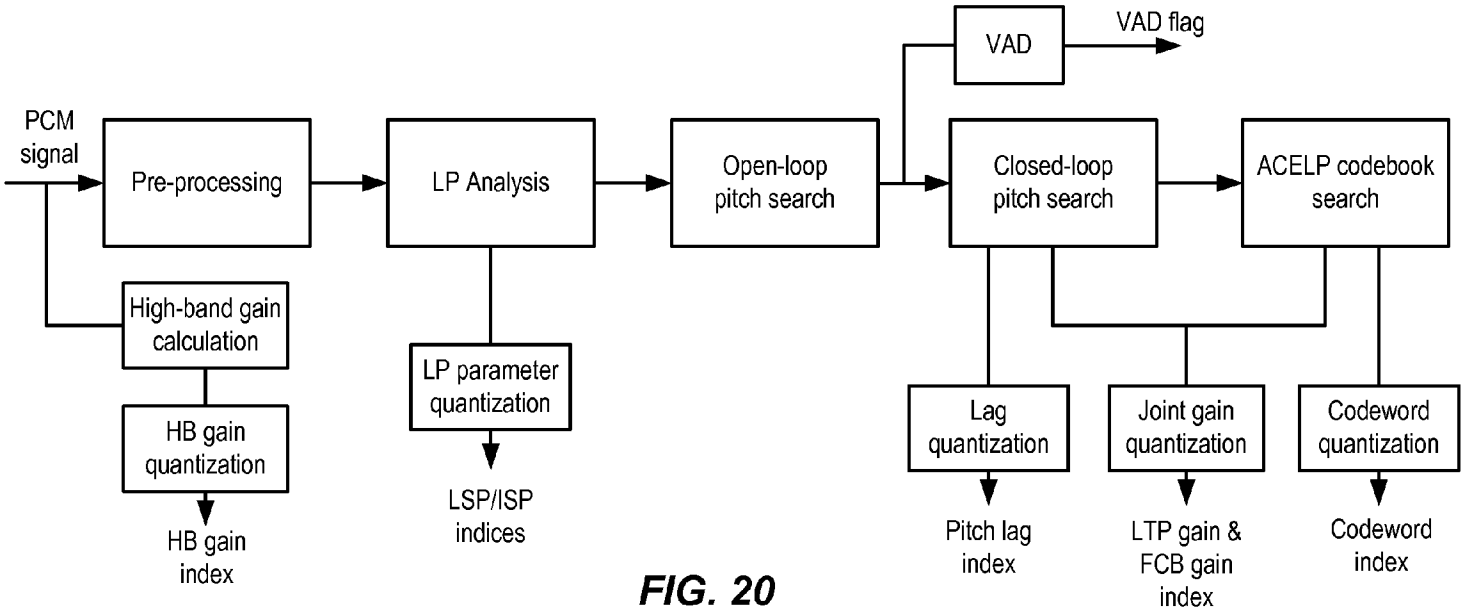
FIG. 20 is a simplified architecture of an embodiment of a multi-codec for EFR, AMR-NB and AMR-WB encoder blocks.

In one preferred embodiment, the Multi-codec architecture is applied to integrate the GSM-EFR, AMR-NB and AMR-WB speech codecs. The foundation structure of the Multi-Codec for GSM-EFR, AMR-NB and AMR-WB is the AMR-NB code. FIG. 20 shows a basic block diagram of the Multi codec encoder blocks. To integrate bit-exact EFR functionality into the Multi-Codec, additional EFR DTX/CNG functions, code and tables are added. A description of how to add AMR-WB functionality is provided herein.

The pre-processing block for AMR-NB comprises high-pass filtering and downscaling. Additional functions to perform upsampling/downsampling and lowpass filtering are added, as well as the AMR-WB lowpass, highpass and tilt filter coefficients.

The LP analysis block comprises autocorrelation calculation, lag windowing and Levinson-Durbin recursion. The encoder function calling routine is adapted to activate the LP analysis routine twice per frame in the case of EFR and 12.2 kbps AMR and once per frame in all other cases. Differing input parameters are the analysis window length in samples, the table accessed for the window coefficients (which is added), and the order of prediction. LP parameter quantization for AMR-WB requires conversion of LP coefficients to ISP coefficients. Instead of adding this additional code, it can be shown that the first 15 ISPs are the same as the line spectral pairs (LSPs) derived from 15th order LP analysis, and the 16th ISP is the 16th linear prediction coefficient (LPC). Hence, the ISPs can be calculated using the AMR-NB LPC-to-LSP and LSP-to-LPC conversion functions with minor alterations. AMR-WB ISP quantization code and tables are added.

The open-loop pitch search block consists primarily of a maximum autocorrelation search on a given signal. The input signal is the weighted speech for AMR-NB, and a filtered, downsampled version of the weighted speech for AMR-WB. The lag weighting functions are identical in form, with slightly different constant values. Code additions for WB include weighting parameters, pitch range values, and interpolating filter coefficients to find ½ and ¼ sample resolution for the closed-loop pitch search block. The quantization of absolute and relative pitch delays used in NB can be shared by WB.

The VAD processing block for AMR-NB comprises 2 options, the first of which is the basis for the AMR-WB VAD approach. While most of the program code is identical, some minor additions need to be made to VAD option 1 such as the AMR-WB VAD filterbank to include frequencies up to 6.4 kHz.

The ACELP codebook search block comprises computing the target signal, pre-calculation of search vectors, and testing particular pulse combinations. The fixed codebook search in AMR-WB and AMR-NB coders is one of the largest functions in terms of program size. This is due to specific fast search methods applied to reduce the number of pulse combinations tested. An exhaustive search can be compactly expressed using nested loops, however, the fast search is individual to each mode and takes up much more space to specify the order tracks are searched, the number of pulse positions optimized at once, and criteria needed to enter each stage. Further, there is a different codebook structure, number of pulses allowed and search combinations for almost every rate. The standard NB search is replaced with a unified ACELP search procedure that adapts to varying codebook structures, track orientation, pulse constraints and search conditions. The procedure has identical variable pre-calculations, specific outer layers which relate to the search order; and identical inner layers which relate to the actual combination testing. This can easily save over 50% of the reference implementation.

High band gain calculation is required for the 23.85 AMR-WB mode and must be added.

Figure 21:
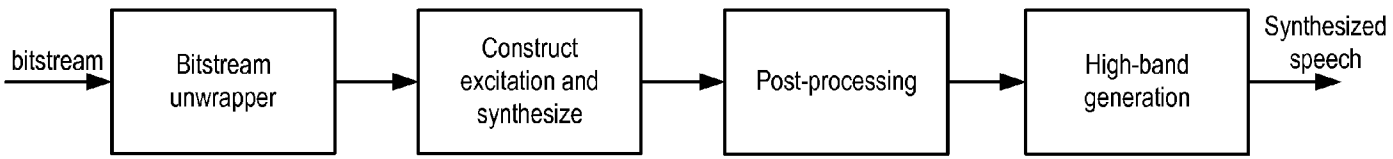
FIG. 21 is a simplified architecture of an embodiment of a multi-codec for EFR, AMR-NB and AMR-WB decoder blocks.

FIG. 21 shows a basic block diagram of the MULTI-CODEC decoder flow. The bitstream unwrapper block comprises decoding the bitstream back to the speech model parameters. Full ISP and fixed codebook shape decoding functions will need to be added for AMR-WB, and slight adaptations made to the NB decoding functions for the common remaining parameters. In addition, ISP extrapolation and spectrum mapping functions are required.

The excitation reconstruction and synthesis block comprises forming the excitation signal by adding the gain-scaled adaptive and fixed codebook contributions, including anti-sparseness processing, and adaptive gain control. Additional functions for noise and pitch enhancement are added for AMR-WB.

The post-processing block includes tilt compensation and formant postfiltering. For WB, function calls for highpass filtering, upsampling/downsampling, and addition of the high-band signal are required. The high-band generation block is only applicable to AMR-WB, and thus must be added in its entirety to the base codec.

As another example for illustration of the bit-compliant specific embodiment, a thin CELP codec is applied to integrate the Code Division Multiple Access (CDMA) standards SMV and EVRC, although others can be used. SMV has 4 bit rates including Rate 1, Rate ½, Rate ¼ and Rate ⅛ and EVRC has 3 bit rates including Rate 1, Rate ½ and Rate ⅛.

Figure 16:
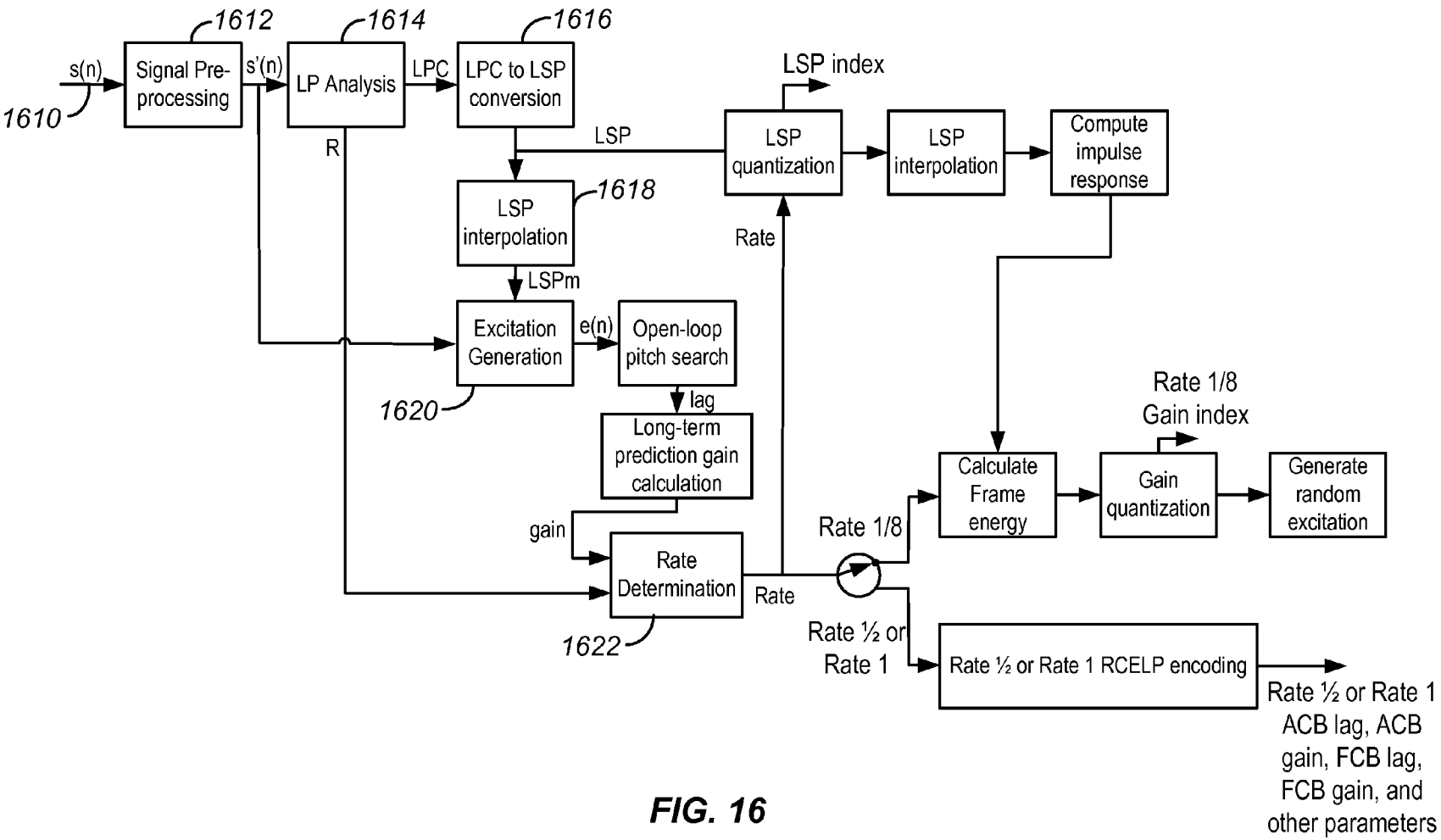
FIG. 16 is a simplified block diagram for an encoder for EVRC.

FIG. 16 is a simplified block diagram for an encoder for EVRC. A signal 1610 is passed to a pre-processing module 1612 which performs highpass filtering to suppress very low frequencies and noise reduction to lessen background noise. Linear prediction analysis is performed by a module 1614 once per frame using the Levinson-Durbin recursion producing autocorrelation coefficients and linear prediction coefficients (LPCs). The LPCs are converted to LSPs by a module 1616 and interpolated by a module 1618. The excitation is generated by a module 1620 that performs inverse filtering of the pre-processed speech by the inverse linear prediction filter. The open-loop pitch lag and pitch gain are then estimated. Using the autocorrelation coefficients, the pitch gain, and an external rate command, the bit rate for the current frame is determined by a module 1622. The rate determination module 1622 applies voice activity detection (VAD) and logic operations to determine the rate. Depending on the bit rate, a different processing path is selected. For Rate ⅛, the parameters transmitted are the LSPs, quantized to 8 bits, and the frame energy. For Rate ½ and Rate 1, the LSPs, pitch lag, adaptive codebook gain, fixed codebook indices and fixed codebook gains are computed. Rate 1 has the additional parameters of spectral transition indicator and delay difference. The LSFs are quantized first and RCELP processing is performed, whereby the signal is modified by time-warping so that the signal has a smooth pitch contour. The adaptive and fixed codebook vectors are selected to match the modified speech signal.

Figure 17:
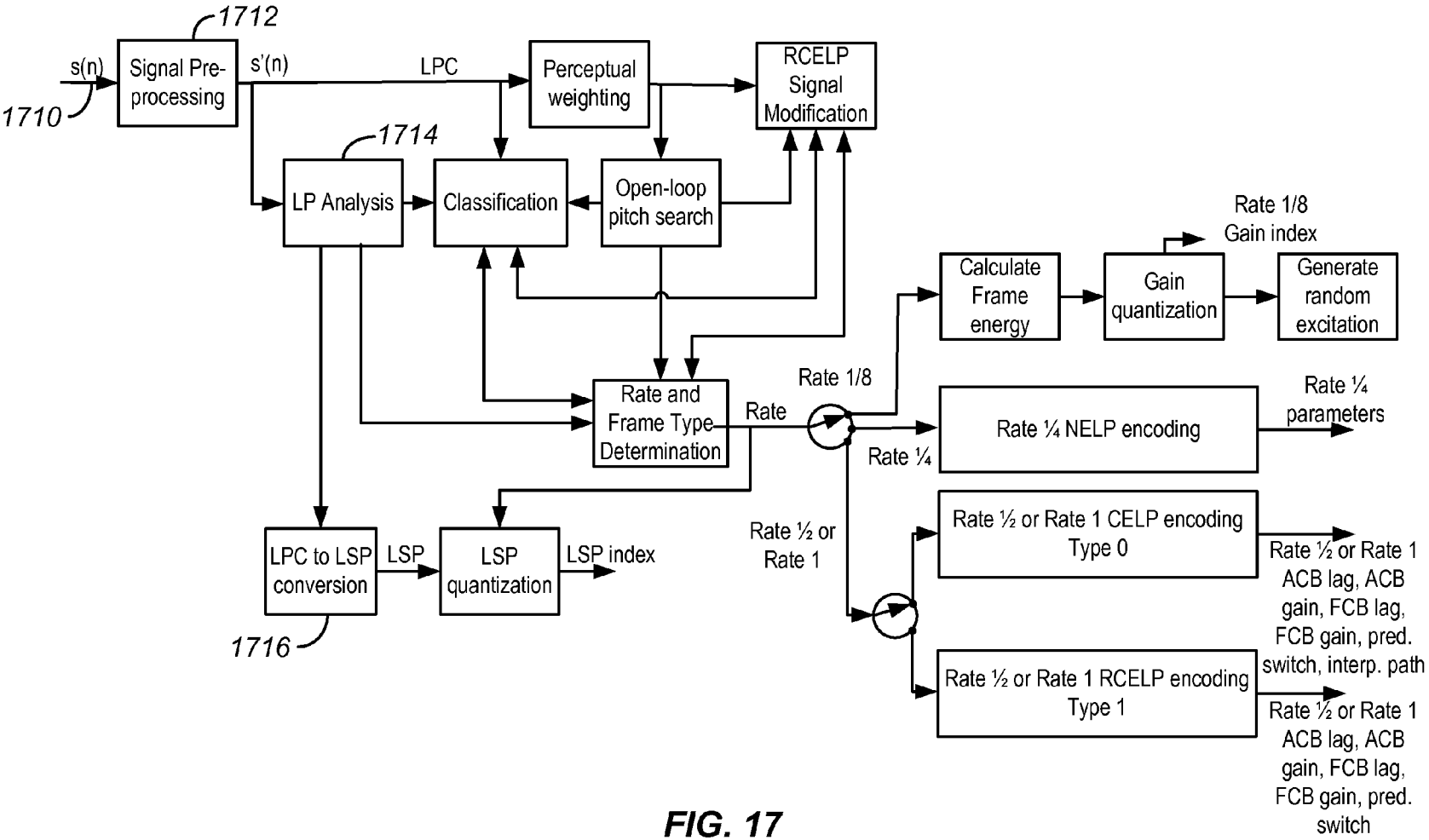
FIG. 17 is a simplified block diagram of the encoder for SMV.

FIG. 17 is a simplified block diagram of the encoder for SMV. A signal 1710 is passed to a pre-processing module 1712 which performs silence enhancement, highpass filtering, noise reduction and adaptive tilt filtering. Linear prediction analysis is performed by a module 1714 three times per frame, centered at different locations, using the Levinson-Durbin recursion producing autocorrelation coefficients and linear prediction coefficients (LPCs). The LPCs are converted to LSPs by a module 1716. The pre-processed speech is perceptually weighted, and the open-loop pitch lag and frame class/type are estimated. The lag is used to modify the pre-processed speech by time-warping and the frame class may be updated. Using numerous analysis parameters, including the frame class, the bit rate for the current frame is determined. Depending on the bit rate and frame type, a different processing path is selected. For Rate ⅛, the parameters transmitted are the LSPs, quantized to 11 bits, and the subframe gains. For Rate ¼, noise excited linear prediction (NELP) processing is performed. For Rate ½ and Rate 1, two processing paths are available for each rate, Type 1 and Type 0. In each case, the LSPs, LSP predictor switch, adaptive codebook lags, adaptive codebook gain, fixed codebook indices and fixed codebook gains are computed. Rate 1, Type 0 has the additional parameter of LSP interpolation path. The LSFs are quantized first and either CELP (Type 0) or RCELP (Type 1) processing is performed, whereby the signal is modified by time-warping so that the signal has a smooth pitch contour.

A comparison of certain features and processing functions of SMV and EVRC according to an embodiment of the present invention is shown in Table 2. This table is merely an example, which should not unduly limit the scope of the present invention. One of ordinary skill in the art would recognize many variations, alternatives, and modifications.

TABLE 2

| | SMV | EVRC |
|---|---|---|
| Frame size | 20 ms | 20 ms |
| Subframes per frame | 4, 3, or 2 depending on Rate and Frame type | 3 (53, 53, 54 samples) |
| Sampling rate | 8 kHz | 8 kHz |
| Pre-processing | Silence enhancement<br>High-pass filtering (80 Hz, $2^{nd}$ order)<br>Noise pre-processing (2 options)<br>Adaptive Tilt filter | Highpass filtering (120 Hz, 6th order)<br>Noise pre-processing (same as SMV option A) |
| LP analysis | $10^{th}$ order LP analysis<br>LPC to LSP conversion | $10^{th}$ order LP analysis<br>LPC to LSP conversion |
| Rate Selection/ VAD | Rate based on input characteristics<br>2 VAD options | Rate based on input characteristics<br>(Rate determination identical to one of SMV VAD options) |
| LSP Quant. | Switched MA prediction, 2 predictors<br>Weighted Multi-stage VQ (MSVQ) | Weighted Split Vector Quantization (SVQ) |
| Pitch search | Integer and fractional delay search on weighted speech | Integer pitch search on residual<br>No closed-loop search |
| Target signal | RCELP signal modification<br>Warp/Shift weighted speech to match pitch contour | RCELP signal modification<br>Shift residual to match pitch contour |
| Fixed codebook | ACELP and Gaussian codebooks<br>Iterative depth-first tree search | ACELP codebooks<br>Iterative depth-first search or exhaustive search |
| Gain guantization | Joint quantization of adaptive and fixed gains | Separate quantization of adaptive and fixed gains |
| Low rates | NELP processing for Rate ¼<br>Gaussian excitation for Rate ⅛ | Gaussian excitation for Rate ⅛ |
| Post processing | Tilt compensation<br>Formant post-filter<br>Long-term postfilter<br>Highpass filtering | Formant postfilter<br>Highpass filtering |

As shown in Table 2, SMV and EVRC share a high degree of similarity. At the basic operations level, SMV math functions are based on EVRC libraries. At the algorithm level, both codecs have a frame size of 20 ms and determine the bit rate for each frame based on the input signal characteristics. In each case, a different coding scheme is used depending on the bit rate. SMV has an additional rate, Rate ¼, which uses NELP encoding. The noise suppression and rate selection routines of EVRC are identical to SMV modules. SMV contains additional preprocessing functions of silence enhancement and adaptive tilt filtering. The 10th order LP analysis is common to both codecs, as is the RCELP processing for the higher rates which modifies the target signal to match an interpolated delay contour. Both codecs use an ACELP fixed codebook structure and iterative depth-first tree search. SMV also uses Gaussian fixed codebooks. At Rate ⅛, both codecs produce a pseudo-random noise excitation to represent the signal. SMV incorporates the full range of post-processing operations including tilt compensation, formant postfilter, long term postfilter, gain normalization, and highpass filtering, whereas EVRC uses a subset of these operations.

Figure 18:
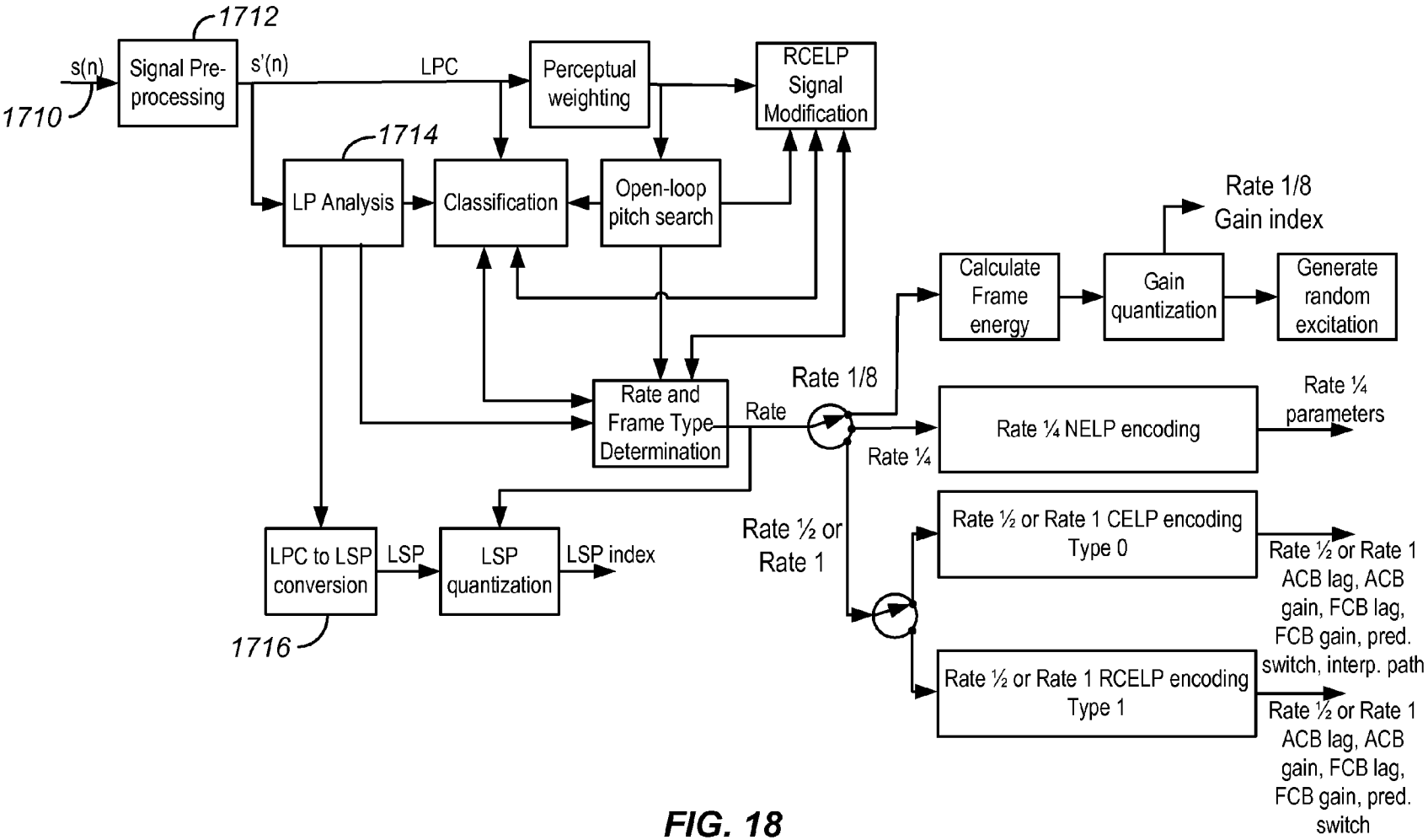
FIG. 18 is a simplified block diagram of an embodiment of an encoder of a thin codec for SMV and EVRC according to an embodiment of the present invention.

FIG. 18 is a simplified block diagram of an embodiment of an encoder of a thin codec for SMV and EVRC according to an embodiment of the present invention. This diagram is merely an example, which should not unduly limit the scope of the present invention. One of ordinary skill in the art would recognize many variations, alternatives, and modifications. A module 1810 for LP analysis, a module 1812 for LPC to LSP conversion, a module 1814 for perceptual weighting, a module 1816 for open-loop pitch search, a module 1818 for RCELP modification, and module 1820 for generating random excitation have a high degree of similarity and can be generic. The module 1810 may perform autocorrelation and Levinson-Durbin processing. Additionally, modules for interpolation, adaptive and fixed target computation, and impulse response computation also have a high degree of similarity and can be generic. The Rate ⅛ processing is similar to both SMV and EVRC codecs, while the Rate 1 and Rate ½ processing of EVRC is similar to Type 1 SMV processing. SMV requires additional classification processing to accurately classify the input, and additional processing paths to accommodate both Type 1 and Type 0 processing. Many of the fixed codebook search functions are generic as both codecs include ACELP codebooks. Since SMV is considerably more algorithmically complex than EVRC, a possible approach for one or more of the thin codec encoding modules, for example the rate determination module, is to embed EVRC functionality within the SMV processing modules. These modules may be split into stages, with some stages generic to each codec. Other modules containing some generic stages include module 1822 for pre-processing, and module 1824 for rate determination.

Figure 19:
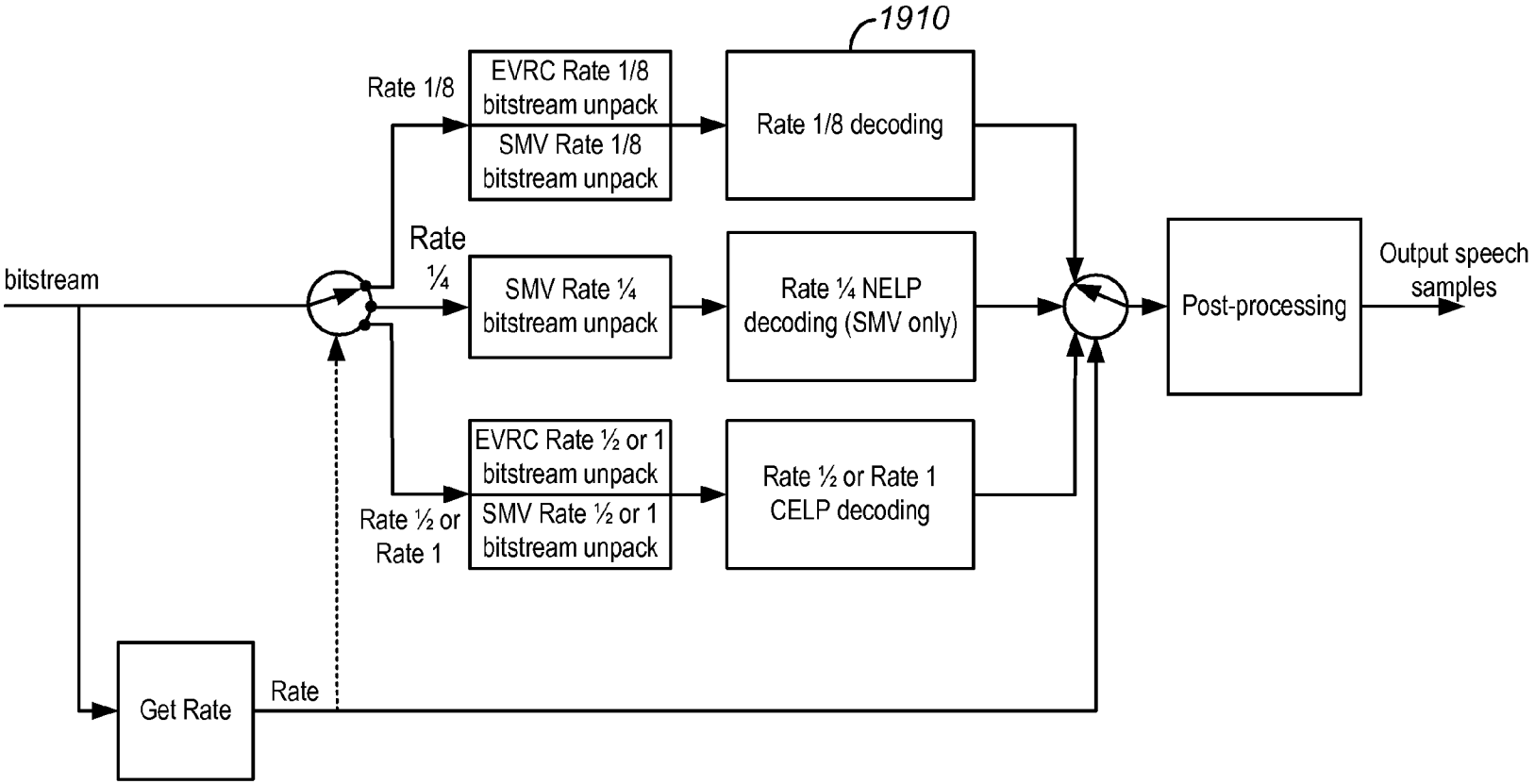
FIG. 19 is a simplified block diagram of an embodiment of an decoder of a thin codec for SMV and EVRC according to an embodiment of the present invention.

FIG. 19 is a simplified block diagram of an embodiment of a decoder of a thin codec for SMV and EVRC according to an embodiment of the present invention. This diagram is merely an example, which should not unduly limit the scope of the present invention. One of ordinary skill in the art would recognize many variations, alternatives, and modifications. Similar to the encoder as shown in FIG. 18, there are different processing paths, depending on the bit rate. The bitstream decoding modules are codec-specific and the post-processing operations for EVRC can be embedded within the SMV post-processing module. Module 1910 for Rate ⅛ decoding has a high degree of similarity and can be generic. In addition to shared decoding modules, common tables, subfunctions and operations of codec-specific modules are also factorized out into a shared library to further reduce the program size.

Embodiment

Multi-Codec for CDMA Codecs

Figure 22:
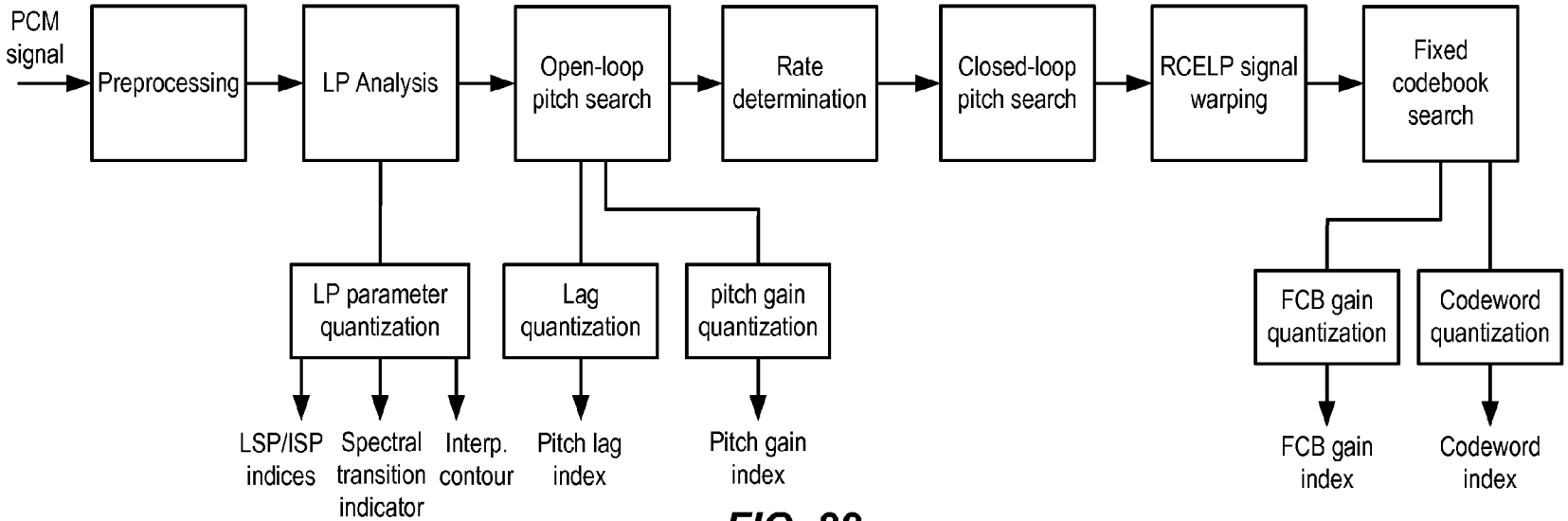
FIG. 22 is a simplified architecture of an embodiment of a multi-codec for SMV and EVRC encoder blocks.

In a second preferred embodiment, the Multi-Codec architecture is applied to integrate the SMV and EVRC codecs. The foundation program code for this embodiment is the SMV program code. This is due to the large comparative size of SMV, which encompasses a broad selection of processing tools. A description of how to integrate EVRC functionality is provided herein. FIG. 22 shows a basic block diagram of the Multi-Codec for SMV and EVRC encoder blocks. The flow for SMV is not a simple direct flow as in EVRC, as it uses combined closed-loop, open-loop analysis (COLA) and repetitively loops back to recalculate and refine each parameter. Thus, in one possible implementation, separate main encoder interfaces that call shared modules are used. EVRC uses 3 subframes for all rates which equivalent to SMV Rate ½, Frame Type 1 processing. Hence, the SMV code will already accommodate the appropriate subframe lengths in most cases.

The pre-processing block for SMV comprises silence enhancement, highpass filtering, noise suppression (2 options) and adaptive tilt filtering. All that is needed to be added for EVRC are the highpass filter coefficients, and a function call to cascade three SMV 2nd order filters. The EVRC noise suppression routine is identical to SMV noise suppression Option A.

The LP analysis block comprises autocorrelation calculation, lag windowing and Levinson-Durbin recursion. LP analysis is performed three times per frame in the case of SMV and once per frame for EVRC. The algorithms are identical with the exception of different analysis window lengths, analysis window coefficients, and lag window constants. These values are added, in addition to EVRC line spectral pair (LSP) quantization code and tables and large spectral transition flag calculations.

The open-loop pitch search block comprises finding the maximum autocorrelation of a given signal. The input signal is the weighted speech for SMV, and a filtered, downsampled version of the residual for EVRC. The EVRC pitch search is also follows an autocorrelation approach, but is far simpler than the SMV search, hence only small code additions are required. The closed-loop pitch search block is only applicable to SMV. The pitch lag quantization algorithm for EVRC is a subset of the quantization code already present in the SMV standard.

The rate determination block comprises functions to set the transmission rate and classify the frame type. The EVRC rate determination is identical to one of the SMV VAD options.

The RCELP signal modification block comprises forming an interpolated pitch contour and modifying the speech to match this contour. Interpolating filter coefficients and small functions to form the EVRC delay contour are added. The pulse shifting functions are shared, as SMV uses a dual warp/shift approach, part of which is the same as the pulse shifting of EVRC.

The fixed codebook search block comprises 2 main parts: ACELP codebooks and noise-excited codebooks. The fixed codebook search functions for the higher rates in SMV and EVRC coders are the largest in terms of program size. A similar approach to that described in the first embodiment can be applied here. SMV uses a more efficient different grouping and factorization of variables in calculations, which will lead to reduced EVRC complexity.

The EVRC fixed and adaptive gains are separately encoded. EVRC gain tables are added to the UTC, and corresponding gain quantization code.

Figure 23:
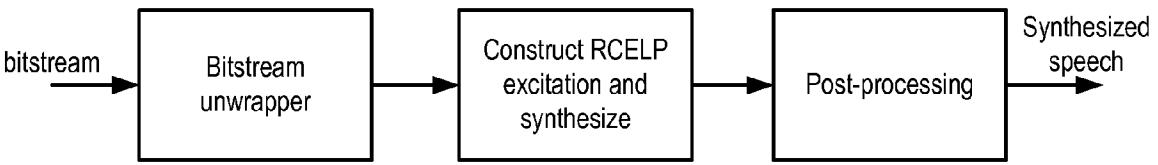
FIG. 23 is a simplified architecture of an embodiment of a multi-codec for SMV and EVRC decoder blocks.

FIG. 23 shows a basic block diagram of the UTC decoder flow. The bitstream unwrapper block comprises decoding the bitstream back to the speech model parameters. Full EVRC bitstream decoding functions will need to be added.

The excitation reconstruction and synthesis block comprises warping the adaptive codebook with the decoded lag, forming the excitation signal by adding the gain-scaled adaptive and fixed codebook contributions. For the post-processing block, apart from allowing for different filter coefficients and weighting factors, no code in addition to the standard SMV code is needed.

For the high performance approach, in addition to the common modules, the functions performing RCELP pulse peak picking, delay contour selection and target signal computation are modified from the standard and a common technique is applied to both standards.

As discussed above and further emphasized here, FIGS. 18 and 19 are merely examples. The apparatus and method for a thin CELP voice codec is applicable to numerous combinations of various voice codecs. For example, these voice codecs include G.723.1, GSM-AMR, EVRC, G.728, G.729, G.729A, QCELP, MPEG-4 CELP, SMV, AMR-WB, and VMR. Usually, the more similar the codec algorithms, the greater the potential achievable program size savings.

Numerous benefits are achieved using the present invention over conventional techniques. Certain embodiments of the present invention can be used to reduce the program size of the encoder and decoder modules to be significantly less than the combined program size of the individual voice compression modules. Some embodiments of the present invention can be used to produce improved voice quality output than the standard codec implementation. Certain embodiments of the present invention can be used to produce lower computational complexity than the standard codec implementation. Some embodiments of the present invention provide efficient embedding of a number of standard codecs and facilitate interoperability of handsets with diverse networks.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. An apparatus for encoding an audio signal, the apparatus comprising:

an encoder configured to generate an output bitstream signal from an input audio signal, the output bitstream signal associated with at least a first standard of a plurality of audio compression standards, the encoder comprising:

a plurality of codec-specific encoder modules, at least one of the plurality of codec-specific encoder modules including at least a first table or a first function, the first table or the first function associated with only a second standard of the plurality of audio compression standards; and a plurality of generic encoder modules, at least one of the plurality of generic encoder modules including at least a second table or a second function, the second table or the second function associated with at least a third standard and a fourth standard of the plurality of audio compression standards, the third standard being different from the fourth standard.

2. The apparatus of claim 1 wherein the plurality of generic encoder modules comprises:

a first common functions library including at least the second function; and a first common tables library including at least the second table.

3. The apparatus of claim 1 wherein the plurality of codec-specific encoder modules comprise:

a pre-processing module configured to process the audio signal for encoding;

a linear prediction analysis module configured to generate linear prediction parameters;

an excitation generation module configured to generate an excitation signal by filtering the audio signal by the short-term prediction filter;

a long-term prediction module configured to generate open-loop pitch lag parameters;

an adaptive codebook module configured to determine an adaptive codebook lag and an adaptive codebook gain;

a fixed codebook module configured to determine fixed codebook vectors and a fixed codebook gain; and a bitstream packing module including at least one bitstream packing routine and configured to generate the output bitstream signal based on at least one or more codec-specific parameters associated with at least the first standard of the plurality of audio compression standards.

4. The apparatus of claim 1 wherein the first standard of the plurality of audio compression standards is the same as the second standard of the plurality of audio compression standards.

5. The apparatus of claim 1 wherein the first standard of the plurality of audio compression standards is the same as the third standard or the fourth standard of the plurality of audio compression standards.

6. The apparatus of claim 1 further comprising a second encoder configured to generate a second output bitstream signal from the input audio signal, the second output bitstream signal associated with at least another standard of the plurality of audio compression standards, the another standard being different from the first standard.

7. An apparatus for decoding an audio signal, the apparatus comprising:

a decoder configured to generate an output audio signal from an input bitstream signal, the input bitstream signal associated with at least a first standard of a plurality of audio compression standards, wherein the decoder comprises:

a plurality of codec-specific decoder modules, at least one of the plurality of codec-specific decoder modules including at least a third table or a third function, the third table or the third function associated with only a second standard of the plurality of audio compression standards; and a plurality of generic decoder modules, at least one of the plurality of generic decoder modules including at least a fourth table or a fourth function, the fourth table or the fourth function associated with at least a third standard and a fourth standard of the plurality of audio compression standards, the third standard being different from the fourth standard.

8. The apparatus of claim 7 wherein the generic decoder modules comprise:

a second common functions library including at least the fourth function; and a second common tables library including at least the fourth table.

9. The apparatus of claim 7 wherein the plurality of codec-specific decoder modules comprise:

a bitstream unpacking module including at least one bitstream unpacking routine and configured to decode the input bitstream signal and generate codec-specific parameters;

an excitation reconstruction module configured to reconstruct an excitation signal based on at least information associated with adaptive codebook lags, adaptive codebook gains, fixed codebook indices and fixed codebook gains;

a synthesis module configured to filter the excitation signal and generate a reconstructed audio signal; and a post-processing module configured to improve a perceptual quality of the reconstructed audio signal.

10. The apparatus of claim 7 wherein the first standard is the same as the second standard.

11. The apparatus of claim 7 wherein the first standard is the same as the third standard or the fourth standard.

12. A method for encoding an audio signal, the method comprising:

receiving an input audio signal;

processing the input audio signal, wherein processing the input audio signal uses at least a first common functions library and at least a first common tables library, the first common functions library including a first function and the first common tables library including a first table, wherein the first function and the first table are associated with at least a second standard and a third standard of the plurality of audio compression standards, the second standard being different from the third standard; and generating an output bitstream signal based on at least information associated with the input audio signal, the output bitstream signal associated with at least a first standard of a plurality of audio compression standards, wherein generating an output signal comprises:

generating a first plurality of codec-specific parameters based on at least information associated with the input audio signal; and packing the first plurality of codec-specific parameters to the output bitstream signal.

13. The method of claim 12 wherein the first plurality of codec-specific parameters comprise a linear prediction parameter, an adaptive codebook lag, an adaptive codebook gain, a fixed codebook index, and a fixed codebook gain.

14. The method of claim 13 wherein the linear prediction parameter comprises a line spectral frequency.

15. The method of claim 12 wherein the generating a first plurality of codec-specific parameters comprises:

performing a linear prediction analysis;

generating linear prediction parameters;

filtering the input audio signal by a short-term prediction filter;

generating an excitation signal;

determining an adaptive codebook pitch lag parameter;

determining an adaptive codebook gain parameter;

determining an index of a fixed codebook vector associated with a fixed codebook target signal; and determining a gain of the fixed codebook vector.

16. The method of claim 12 wherein the first standard is the same as the second standard or the third standard.

17. The method of claim 12 further comprising generating a second output bitstream signal based on at least information associated with the input audio signal, the output bitstream signal associated with at least another standard of the plurality of audio compression standards, the another standard being different from the first standard.

18. A method for decoding an audio signal, the method comprising:

receiving an input bitstream signal;

processing the input bitstream signal, wherein processing the input bitstream signal uses at least a second common functions library and a second common tables library, the second common functions library including a second function and the second common tables library including a second table; wherein the second function and the second table are associated with at least a second standard and a third standard of the plurality of audio compression standards, the second standard being different from the third standard; and generating an output audio signal based on at least information associated with the input bitstream signal, the output audio signal associated with at least a first standard of a plurality of audio compression standards, wherein generating an output audio signal comprises:

unpacking the input bitstream signal; and decoding a second plurality of codec-specific parameters to produce an output audio signal.

19. The method of claim 18 wherein decoding a second plurality of codec-specific parameters comprises:

reconstructing an excitation signal;

synthesizing the excitation signal;

generating an intermediate audio signal; and processing the intermediate audio signal to improve a perceptual quality.

20. The method of claim 18 wherein the first standard is the same as the second standard or the third standard.

* * * * *